US008215418B2

(12) United States Patent
Radford

(10) Patent No.: US 8,215,418 B2
(45) **Date of Patent: *Jul. 10, 2012**

(54) EXPANDABLE REAMER APPARATUS AND RELATED METHODS

(75) Inventor: Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/213,641

(22) Filed: Aug. 19, 2011

(65) Prior Publication Data

US 2011/0297443 A1 Dec. 8, 2011

Related U.S. Application Data

(63) Continuation of application No. 12/749,884, filed on Mar. 30, 2010, now Pat. No. 8,020,635, which is a continuation of application No. 11/875,241, filed on Oct. 19, 2007, now Pat. No. 7,721,823, which is a continuation of application No. 11/413,615, filed on Apr. 27, 2006, now Pat. No. 7,308,937, which is a continuation of application No. 10/624,952, filed on Jul. 22, 2003, now Pat. No. 7,036,611.

(60) Provisional application No. 60/399,531, filed on Jul. 30, 2002.

(51) Int. Cl.
*E21B 10/32* (2006.01)

(52) U.S. Cl. ..... 175/57; 175/269; 175/406

(58) Field of Classification Search ..... 175/57, 175/267, 269, 280, 291, 406
See application file for complete search history.

(56) References Cited

U.S. PATENT DOCUMENTS 1,470,545 A 10/1923 Rossignol
1,678,075 A 7/1928 Phipps
1,764,373 A 6/1930 Wells et al.
(Continued)

FOREIGN PATENT DOCUMENTS

EP 0707130 A2 4/1996
(Continued)

OTHER PUBLICATIONS

The Andergauge Anderreamer and Security DBS NBR, A Differentiation Between Tools, Andergauge Drilling Systems, www.andergauge.com., 2001 (4 pages).

(Continued)

*Primary Examiner* — William P Neuder
(74) *Attorney, Agent, or Firm* — TraskBritt

(57) ABSTRACT

An expandable reamer apparatus and methods for reaming a borehole, wherein a laterally movable blade carried by a tubular body may be selectively positioned at an inward position and an expanded position. The laterally movable blade, held inwardly by blade-biasing elements, may be forced outwardly by drilling fluid selectively allowed to communicate therewith by way of an actuation sleeve disposed within the tubular body. Alternatively, a separation element may transmit force or pressure from the drilling fluid to the movable blade. Further, a chamber in communication with the movable blade may be pressurized by way of a downhole turbine or pump. A ridged seal wiper, compensator, movable bearing pad, fixed bearing pad preceding the movable blade, or adjustable spacer element to alter expanded blade position may be included within the expandable reamer. In addition, a drilling fluid pressure response indicating an operational characteristic of the expandable reamer may be generated.

20 Claims, 24 Drawing Sheets

U.S. PATENT DOCUMENTS

| | | | |
|---|---|---|---|
| 1,878,260 | A | 9/1932 | Bunker |
| 2,054,277 | A | 9/1936 | Wright |
| 2,069,482 | A | 2/1937 | Seay |
| 2,126,146 | A | 8/1938 | Smith |
| 2,126,246 | A | 8/1938 | Deitz, Jr. |
| 2,427,052 | A | 9/1947 | Grant |
| 2,638,988 | A | 5/1953 | Williams |
| 2,834,578 | A | 5/1958 | Carr |
| 2,857,141 | A | 10/1958 | Carpenter |
| 2,882,019 | A | 4/1959 | Carr et al. |
| 3,051,255 | A | 8/1962 | Deeley |
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,433,313 | A | 3/1969 | Brown |
| 3,554,305 | A | 1/1971 | Kammerer, Jr. |
| 3,556,233 | A | 1/1971 | Gilreath et al. |
| 4,386,669 | A | 6/1983 | Evans |
| 4,458,761 | A | 7/1984 | Van Vreeswyk |
| 4,503,919 | A | 3/1985 | Suied |
| 4,565,252 | A | 1/1986 | Campbell et al. |
| 4,589,504 | A | 5/1986 | Simpson |
| 4,635,738 | A | 1/1987 | Schillinger et al. |
| 4,727,942 | A | 3/1988 | Galle et al. |
| 4,792,000 | A | 12/1988 | Perkin et al. |
| 4,842,083 | A | 6/1989 | Raney |
| 4,889,197 | A | 12/1989 | Boe |
| 5,010,967 | A | 4/1991 | Desai |
| 5,139,098 | A | 8/1992 | Blake |
| RE34,054 | E | 9/1992 | Millington et al. |
| 5,230,390 | A | 7/1993 | Zastresek et al. |
| 5,293,945 | A | 3/1994 | Rosenhauch et al. |
| 5,318,138 | A | 6/1994 | Dewey et al. |
| 5,341,888 | A | 8/1994 | Deschutter |
| 5,368,114 | A | 11/1994 | Tandberg et al. |
| 5,375,662 | A | 12/1994 | Echols, III et al. |
| 5,402,856 | A | 4/1995 | Warren et al. |
| 5,447,207 | A | 9/1995 | Jones |
| 5,447,208 | A | 9/1995 | Lund et al. |
| 5,492,186 | A | 2/1996 | Overstreet et al. |
| 5,495,899 | A | 3/1996 | Pastusek et al. |
| 5,497,842 | A | 3/1996 | Pastusek et al. |
| 5,582,258 | A | 12/1996 | Tibbitts et al. |
| 5,653,300 | A | 8/1997 | Lund et al. |
| 5,663,512 | A | 9/1997 | Schader et al. |
| 5,765,653 | A | 6/1998 | Doster et al. |
| 5,788,000 | A | 8/1998 | Maury et al. |
| 5,853,054 | A | 12/1998 | McGarian et al. |
| 5,957,223 | A | 9/1999 | Doster et al. |
| 5,967,250 | A | 10/1999 | Lund et al. |
| 6,131,675 | A | 10/2000 | Anderson |
| 6,145,608 | A | 11/2000 | Lund et al. |
| RE37,127 | E | 4/2001 | Schader et al. |
| 6,328,117 | B1 | 12/2001 | Berzas et al. |
| 6,360,831 | B1 | 3/2002 | Akesson et al. |
| 6,378,632 | B1 | 4/2002 | Dewey et al. |
| 6,408,958 | B1 | 6/2002 | Isbell et al. |
| 6,450,271 | B1 | 9/2002 | Tibbitts et al. |
| 6,460,631 | B2 | 10/2002 | Dykstra et al. |
| 6,499,537 | B1 | 12/2002 | Dewey et al. |
| 6,510,906 | B1 | 1/2003 | Richert et al. |
| 6,651,756 | B1 | 11/2003 | Costo, Jr. et al. |
| 6,695,080 | B2 | 2/2004 | Presley et al. |
| 6,702,020 | B2 | 3/2004 | Zachman et al. |
| 6,732,817 | B2 | 5/2004 | Dewey et al. |
| 6,739,416 | B2 | 5/2004 | Presley et al. |
| 6,769,500 | B2 | 8/2004 | Miglierini |
| 6,779,613 | B2 | 8/2004 | Dykstra et al. |
| 6,802,380 | B2 | 10/2004 | Blackman |
| 6,973,978 | B2 | 12/2005 | Cravatte |
| 7,036,611 | B2 | 5/2006 | Radford et al. |
| 7,048,078 | B2 | 5/2006 | Dewey et al. |
| 7,293,616 | B2 | 11/2007 | Tulloch |
| 7,308,937 | B2 | 12/2007 | Radford et al. |
| 7,314,099 | B2 | 1/2008 | Dewey et al. |
| 7,549,485 | B2 | 6/2009 | Radford et al. |
| 7,594,552 | B2 | 9/2009 | Radford et al. |
| 7,681,666 | B2 | 3/2010 | Radford et al. |
| 8,020,635 | B2 * | 9/2011 | Radford ..... 175/57 |
| 2002/0070052 | A1 | 6/2002 | Armell et al. |
| 2003/0164251 | A1 | 9/2003 | Tulloch |
| 2004/0222022 | A1 | 11/2004 | Nevlud |
| 2005/0145417 | A1 | 7/2005 | Radford et al. |
| 2008/0105464 | A1 | 5/2008 | Radford |
| 2008/0115973 | A1 | 5/2008 | Rives |
| 2010/0282511 | A1 | 11/2010 | Maranuk et al. |
| 2011/0073370 | A1 * | 3/2011 | Gentry ..... 175/57 |

FOREIGN PATENT DOCUMENTS

| | | | |
|---|---|---|---|
| GB | 2287051 | A | 9/1995 |
| GB | 2320270 | A | 6/1998 |
| GB | 2378718 | A | 2/2003 |

OTHER PUBLICATIONS

Anderreamer Reliable Underreaming Below Casing, Andergauge Drilling Systems, www.andergauge.com. 2000 (2 pages).

European Search Report for Belgian Patent Application No. 200300430, dated Mar. 1, 2006, 3 pages.

European Search Report for Belgian Patent Application No. BE20050000582 20051130 (Publication No. BE1017310) dated Jun. 29, 2007, 4 pages.

UK Patent Office Search Report for Application No. GB0317397.8, dated Nov. 6, 2003, 4 pages.

UK Patent Office Search Report for Application No. GB0524344.9,dated Feb. 15, 2006, 1 page.

* cited by examiner

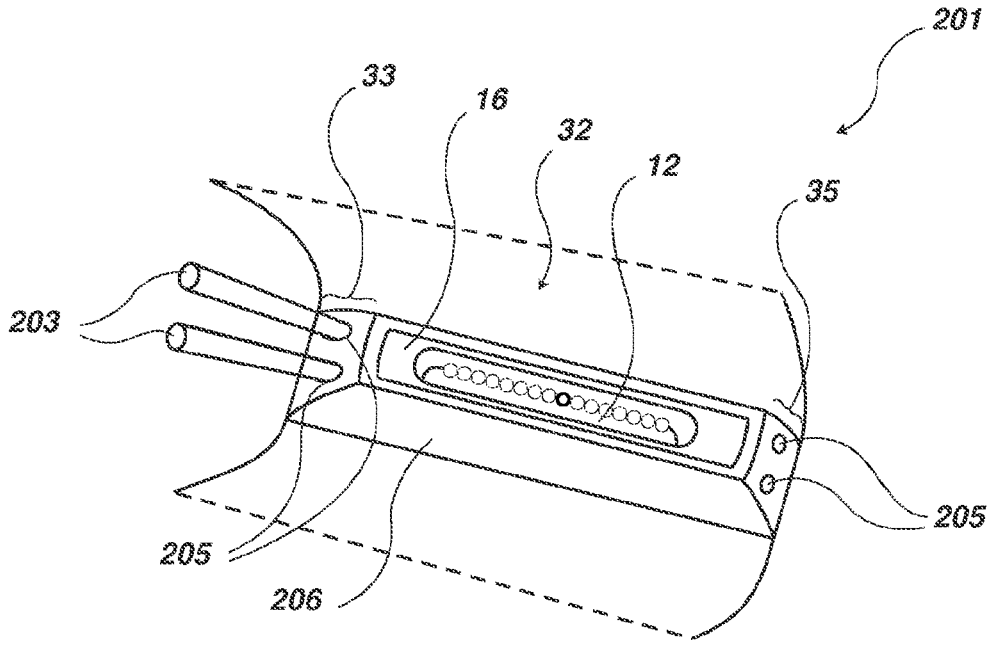
FIG. 1D1
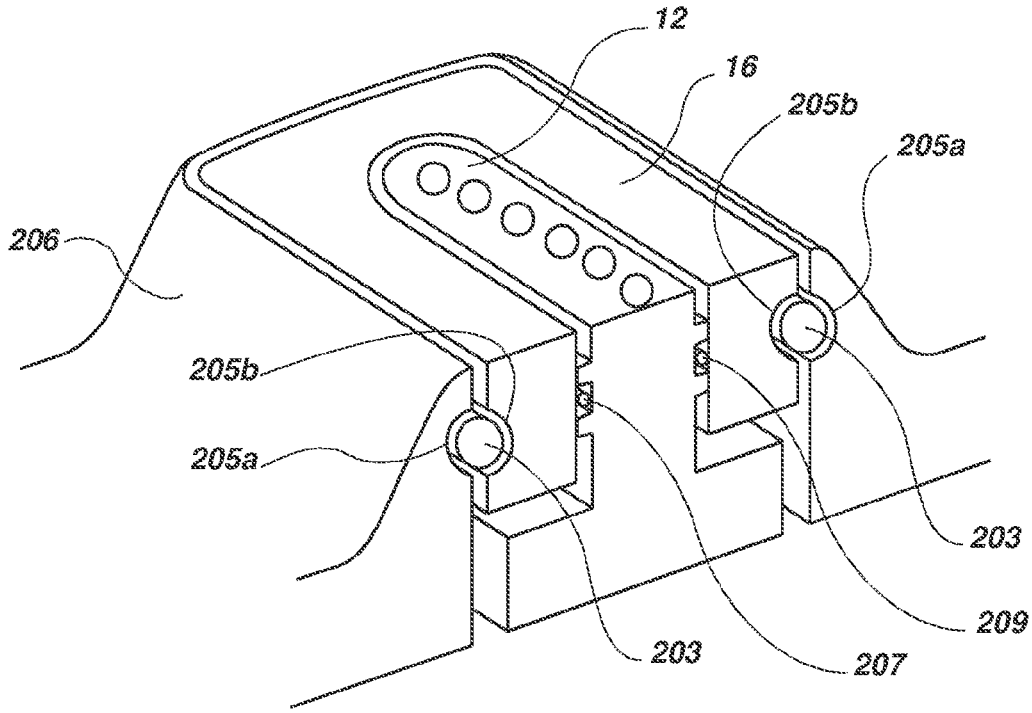
FIG. 1D2

EXPANDABLE REAMER APPARATUS AND RELATED METHODS

CROSS-RESFERENCE TO RELATED APPLICATIONS

This application is a continuation of U.S. patent application Ser. No. 12/749,884, filed Mar. 30, 2010, now U.S. Pat. No. 8,020,635, issued Sep. 20, 2011, which is a continuation of U.S. patent application Ser. No. 11/875,241, filed Oct. 19, 2007, now U.S. Pat. No. 7,721,823, issued May 25, 2010, which application is a continuation of U.S. patent application Ser. No. 11/413,615, filed Apr. 27, 2006, now U.S. Pat. No. 7,308,937, issued Dec. 18, 2007, which is a continuation of U.S. patent application Ser. No. 10/624,952, filed Jul. 22, 2003, now U.S. Pat. No. 7,036,611, issued May 2, 2006, which claims the benefit of U.S. Provisional Patent Application Ser. No. 60/399,531, filed Jul. 30, 2002, for EXPANDABLE REAMER APPARATUS FOR ENLARGING BOREHOLES WHILE DRILLING AND METHOD OF USE. This application is also related to U.S. patent application Ser. No. 10/999,811, filed Nov. 30, 2004, now U.S. Pat. No. 7,549,485, issued Jun. 23, 2009, and to U.S. patent application Ser. No. 11/875,651, filed Oct. 19, 2007, now U.S. Pat. No. 7,681,666, issued Mar. 23, 2010. The entire disclosure of each of the above-identified patent applications and patents is hereby incorporated herein by this reference. This application is also related to U.S. patent application Ser. No. 11/873,346, filed Oct. 16, 2007, now U.S. Pat. No. 7,594,552, issued Sep. 29, 2009, and is also related to U.S. patent application Ser. No. 13/224,085, filed Sep. 1, 2011, pending, which is a continuation of U.S. patent application Ser. No. 12/723,999, filed Mar. 15, 2010, now U.S. Pat. No. 8,047,304, issued Nov. 1, 2011.

FIELD OF INVENTION

The invention, in various embodiments, relates generally to an expandable reamer apparatus for drilling a subterranean borehole and, more specifically, to enlarging a subterranean borehole beneath a casing or liner. The expandable reamer may comprise a tubular body configured with movable blades that may be directly radially or laterally displaced, the movable blades having cutting elements attached thereto.

BACKGROUND

State of the Art: Drill bits for drilling oil, gas, and geothermal wells, and other similar uses typically comprise a solid metal or composite matrix-type metal body having a lower cutting face region and an upper shank region for connection to the bottom hole assembly of a drill string formed of conventional jointed tubular members which are then rotated as a single unit by a rotary table or top drive drilling rig, or by a downhole motor selectively in combination with the surface equipment. Alternatively, rotary drill bits may be attached to a bottom hole assembly, including a downhole motor assembly, which is in turn connected to an essentially continuous tubing, also referred to as coiled, or reeled, tubing, wherein the downhole motor assembly rotates the drill bit. The bit body may have one or more internal passages for introducing drilling fluid, or mud, to the cutting face of the drill bit to cool cutters provided thereon and to facilitate formation chip and formation fines removal. The sides of the drill bit typically may include a plurality of radially or laterally extending blades that have an outermost surface of a substantially constant diameter and generally parallel to the central longitudinal axis of the drill bit, commonly known as gage pads. The gage pads generally contact the wall of the borehole being drilled in order to support and provide guidance to the drill bit as it advances along a desired cutting path, or trajectory.

As known within the art, blades provided on a rotary drill bit may be selected to be provided with replaceable cutting elements installed thereon, allowing the cutting elements to engage the formation being drilled and to assist in providing cutting action therealong. Replaceable cutters may also be placed adjacent to the gage area of the rotary drill bit and sometimes on the gage thereof. One type of cutting element, referred to as inserts, compacts, and cutters, has been known and used for providing the primary cutting action of rotary drill bits and drilling tools. These cutting elements are typically manufactured by forming a superabrasive layer, or table, upon a sintered tungsten carbide substrate. As an example, a tungsten carbide substrate having a polycrystalline diamond table or cutting face is sintered onto the substrate under high pressure and temperature, typically about 1450° C. to about 1600° C. and about 50 kilobar to about 70 kilobar pressure, to form a PDC cutting element or PDC cutter. During this process, a metal sintering aid or catalyst, such as cobalt, may be premixed with the powdered diamond or swept from the substrate into the diamond to form a bonding matrix at the interface between the diamond and substrate.

Further, in one conventional approach to enlarge a subterranean borehole, it is known to employ both eccentric and bi-center bits to enlarge a borehole below a tight or undersized portion thereof. For example, an eccentric bit includes an extended or enlarged cutting portion which, when the bit is rotated about its axis, produces an enlarged borehole. An example of an eccentric bit is disclosed in U.S. Pat. No. 4,635,738, assigned to the assignee of the present invention. Similarly, a bi-center bit assembly employs two longitudinally superimposed bit sections with laterally offset axes. An example of an exemplary bi-center bit is disclosed in U.S. Pat. No. 5,957,223, also assigned to the assignee of the present invention. The first axis is the center of the pass-through diameter, that is, the diameter of the smallest borehole the bit will pass through. Accordingly, this axis may be referred to as the pass-through axis. The second axis is the axis of the hole cut in the subterranean formation as the bit is rotated and may be referred to as the drilling axis. There is usually a first, lower and smaller diameter pilot section employed to commence the drilling, and rotation of the bit is centered about the drilling axis as the second, upper and larger diameter main bit section engages the formation to enlarge the borehole, the rotational axis of the bit assembly rapidly transitioning from the pass-through axis to the drilling axis when the full diameter, enlarged borehole is drilled.

In another conventional approach to enlarge a subterranean borehole, rather than employing a one-piece drilling structure such as an eccentric bit or a bi-center bit to enlarge a borehole below a constricted or reduced-diameter segment, it is also known to employ an extended bottom hole assembly (extended bi-center assembly) with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the borehole as well as the opportunity to effectively stabilize the pilot drill bit so that the pilot hole and the following reamer will traverse the path intended for the borehole. This aspect of an extended bottom hole assembly is particularly significant in directional drilling.

The assignee of the present invention has, to this end, designed as reaming structures so-called "reamer wings," which structures generally comprise a tubular body having a fishing neck with a threaded connection at the top thereof and a tong die surface at the bottom thereof, also with a threaded connection. U.S. Pat. Nos. 5,497,842 and 5,495,899, both assigned to the assignee of the present invention, disclose reaming structures including reamer wings. The upper mid-portion of the reamer wing tool includes one or more longitudinally extending blades projecting generally radially outwardly from the tubular body, the outer edges of the blades carrying PDC cutting elements. The mid-portion of the reamer wing also may include a stabilizing pad having an arcuate exterior surface having a radius that is the same as or slightly smaller than the radius of the pilot hole on the exterior of the tubular body and longitudinally below the blades. The stabilizer pad is characteristically placed on the opposite side of the body with respect to the reamer blades so that the reamer wing tool will ride on the pad due to the resultant force vector generated by the cutting of the blade or blades as the enlarged borehole is cut. U.S. Pat. No. 5,765,653, assigned to the assignee of the present invention, discloses the use of one or more eccentric stabilizers placed within or above the bottom hole reaming assembly to permit ready passage thereof through the pilot hole or pass-through diameter, while effectively radially stabilizing the assembly during the hole-opening operation thereafter.

Conventional expandable reamers may include blades pivotably or hingedly affixed to a tubular body and actuated by way of a piston disposed therein as disclosed by U.S. Pat. No. 5,402,856 to Warren et al. In addition, U.S. Pat. No. 6,360,831 to Åkesson et al. discloses a conventional borehole opener comprising a body equipped with at least two hole-opening arms having cutting means that may be moved from a position of rest in the body to an active position by way of a face thereof that is directly subjected to the pressure of the drilling fluid flowing through the body. However, the face, being directly exposed to the drilling fluid, may be subjected adversely to erosion or chemical effects caused thereby.

Notwithstanding the prior approaches to drill and/or ream a larger-diameter borehole below a smaller-diameter borehole, the need exists for improved apparatus and methods for doing so. For instance, bi-center and reamer wing assemblies are limited in the sense that the pass-through diameter is nonadjustable and limited by the reaming diameter. Further, conventional reaming assemblies may be subject to damage when passing through a smaller diameter borehole or casing section.

BRIEF SUMMARY OF THE INVENTION

The present invention generally relates to an expandable reamer having movable blades that may be positioned at an initial smaller diameter and expanded to a subsequent diameter to ream and/or drill a larger diameter within a subterranean formation. Such an expandable reamer may be useful for enlarging a borehole within a subterranean formation below a particular depth, since the expandable reamer may be disposed within a borehole of an initial diameter and expanded, rotated, and displaced to form an enlarged borehole therebelow.

In one exemplary embodiment, the expandable reamer of the present invention may include an actuation sleeve whose position may determine deployment of a movable blade therein as described below. For instance, an actuation sleeve may be disposed within the expandable reamer and may have a reduced cross-sectional area aperture or orifice that drilling fluid passes through. Thus, the drilling fluid passing through the expandable reamer and reduced cross-sectional aperture or orifice may cause the actuation sleeve to be displaced by the force generated thereby. Sufficient displacement of the actuation sleeve may allow drilling fluid to communicate through apertures in the displaced actuation sleeve with movable blade sections, the pressure of the drilling fluid forcing the movable blades to expand radially or laterally outwardly. Further, the actuation sleeve may be biased in substantially the opposite direction of the force generated by drilling fluid passing through the reduced cross-sectional area of the actuation sleeve by way of a sleeve-biasing element. Such a sleeve-biasing element may cause the actuation sleeve to be repositioned, in the absence of, or against, the force generated by drilling fluid passing through the reduced cross-sectional orifice, thus preventing drilling fluid from communicating with the movable blades of the expandable reamer. Furthermore, the expandable reamer may include blade-biasing elements configured to return or bias the movable blades radially or laterally inward in the absence of, or against, the pressure of the drilling fluid acting on the movable blades. Moreover, a tapered or chamfered surface on the upper longitudinal region of each blade may also facilitate return of that movable blade inwardly as the taper or chamfer contacts the borehole wall. Thus, the expandable reamer of the present invention may return to its initial unexpanded condition depending on the position of the actuation sleeve.

In addition, the outermost position of the movable blades, when expanded, may be adjustable. For instance, the expandable reamer of the present invention may be configured so that an adjustable spacer element may be used to determine the outermost radial or lateral position of a movable blade. Such adjustable spacer element may generally comprise a block or pin that may be adjusted or replaced. In addition, in an embodiment including an actuation sleeve that enables the expansion of the movable blades, a sleeve-biasing element, and blade-biasing elements, the sleeve-biasing element may be configured in relation to the blade-biasing elements for the purpose of adjusting the conditions that may cause the movable blades to expand to their outermost radial or lateral positions. For instance, the sleeve-biasing element and reduced cross-sectional orifice may be configured so that a drilling fluid flow rate above a minimum drilling fluid flow rate causes the sleeve to be displaced, thus allowing drilling fluid to communicate with the movable blades. Accordingly, the blade-biasing elements may be configured so that only a drilling fluid flow rate exceeding the drilling fluid flow rate required to open communication between a movable blade and the drilling fluid may cause the movable blades to move radially or laterally outward to their outermost radial or lateral position.

The expandable reamer of the present invention is not limited to actuation sleeves for activating the expansion of the expandable reamer. Collets, shear pins, valves, burst discs, or other mechanisms that enable the expansion of the movable blades of the expandable reamer in relation to an operating condition thereof may be employed. Moreover, a flow restriction element may be disposed within the drill string to actuate the expansion of the expandable reamer. For instance, a ball may be disposed within the drilling fluid, traveling therein, ultimately seating within an actuation sleeve disposed at a first position. Pressure from the drilling fluid may subsequently build to force the ball and actuation sleeve, optionally held in place by way of a shear pin or other frangible member, into a second position, thereby actuating the expansion of the expandable reamer. Such a configuration may require that once the movable blades are expanded by the ball, in order to contract the movable blades, the flow is diverted around the seated ball to allow a maximum fluid flow rate through the tool. Thus, the expandable reamer may be configured as a "one-shot" tool, which may be reset after actuation.

Further, a pressure-actuated pin guide may be employed to cause the reamer to assume different operational conditions. More specifically, a pin guide may comprise a cylinder with a groove having alternating upwardly sloping and downwardly sloping arcuate paths formed at least partially along the circumference of the cylinder and a pin affixed to an actuation sleeve, the pin disposed within the groove. Alternating opposing forces may be applied to the pin and actuation sleeve assembly to cause the pin to traverse within the groove. One force may be created by way of drilling fluid passing through an orifice and an opposing force may be generated by way of a biasing element, as previously described in relation to an actuation sleeve and associated biasing element. For instance, a relatively high flow rate through the tool may cause the pin to traverse longitudinally downwardly within the groove. Upon the flow rate decreasing, a return force provided by way of the biasing element may cause the pin to traverse longitudinally upwardly within the groove. Further, the longitudinal position of the actuation sleeve may prevent or allow drilling fluid to communicate with the movable blades. Thus, the reamer may be caused to assume different operational conditions as the pin may be caused to traverse within the groove of the pin guide.

Thus, the expandable reamer of the present invention may be configured so that the movable blades expand to an outermost radial or lateral position under selected operating conditions as well as return to an inward radial or lateral position under selected operating conditions. Furthermore, movable blades disposed within the expandable reamer of the present invention may comprise tapered, spiral, or substantially straight longitudinally extending sections extending from the tubular body of the expandable reamer. It also may be advantageous to shape the movable blades so that the longitudinal sides of the movable blades are not straight. For instance, each longitudinal side of the movable blades may comprise an oval, elliptical, or other arcuate shape. Of course, the sides need not be symmetrical, but may be if so desired. Such a configuration may reduce binding of the movable blades as they move radially or laterally inwardly and/or outwardly.

Further, a movable blade of the present invention may be removable and/or replaceable. In one exemplary embodiment, removable lock rods extending through the body of the expandable reamer may be used to affix a spacing element associated with and configured to effectively retain the movable blade within the body of the expandable reamer. Accordingly, removable lock rods extending through the body of the expandable reamer and through the spacing elements may be selectively removed, thus allowing for the spacing element and movable blade to be repaired or replaced. Accordingly, such a configuration may allow for the expandable reamer of the present invention to be easily reconfigured for different diameters or repaired.

PDC cutting elements as described above may be affixed in pockets formed on the movable blades by way of an interference fit or brazing. Alternatively, cutting elements may comprise sintered tungsten carbide inserts ("TCI") without a diamond layer; such a configuration may be useful for drilling out a section of casing, or creating a window within a casing section. Furthermore, blades may be fabricated with impregnated diamond cutting structures as known in the art. Alternatively, an expandable reamer may be configured with rotating roller cones having tungsten carbide inserts, PDC inserts, or steel inserts, as known in the art. Such a configuration may be particularly suited for drilling hard formations.

In addition, structures having an ovoid upper geometry may be disposed along the outer radial or lateral extent of a movable blade at one or more longitudinal positions thereof. Such ovoid structures may be desirable as inhibiting or preventing damage to proximate cutting elements disposed on a movable blade. For example, it may be possible for the respective longitudinal orientations of the expandable reamer or the movable blade to become tilted with respect to the longitudinal axis of the borehole, and cutting elements disposed on the movable blade may engage the sidewall of the borehole in an undesirable fashion. Thus, cutting elements may be damaged by prematurely or excessively contacting the sidewall of the borehole. Ovoid structures disposed along the movable blade may also inhibit or prevent excessive or premature contact between the sidewall of the borehole and associated cutting elements on the movable blade during certain types of operational conditions, such as whirling, rotation within a casing, or other unstable motion. Likewise, movable blades may be configured with rate-of-penetration ("ROP") limiters and/or BRUTE® cutters, available from Hughes Christensen Company, located in Houston, Tex., as known in the art, to tailor the force/torque response of the expandable reamer during drilling operations.

In operating the expandable reamer of the present invention, it may be desirable to ascertain the operational state of the expandable reamer within the subterranean formation. To this end, a perceptible pressure response within the drilling fluid may indicate an operational state of the expandable reamer. For instance, upon drilling fluid communicating or ceasing to communicate with the movable blades, a perceptible pressure response may be generated. In one embodiment, some of the pressure communicating with the movable blades may be released through open nozzle orifices near each blade. This would result in a sudden decrease in pressure, indicating that the actuation sleeve has shifted to the lower position. In another embodiment, as the actuation sleeve is displaced so as to allow the drilling fluid passing through the reamer to communicate through apertures in the actuation sleeve with the movable blades, the internal pressure of the drilling fluid may drop noticeably. Subsequently, as the actuation sleeve is displaced to its lowermost longitudinal position and the blades expand to their outermost radial or lateral position, the pressure may increase perceptibly and may even increase over the steady-state operational pressure of the expandable reamer when the movable blades are expanded to their outermost radial or lateral position. In addition, a perceptible pressure response may occur as the drilling pressure drops, an actuation sleeve is displaced upwardly, and the drilling fluid within the reamer ceases to communicate with the movable blade sections.

Pressure response characteristics of the expandable reamer may also be changed or modified without removing the expandable reamer from the borehole. In one embodiment, an area restriction element may be positioned by way of a wireline to further reduce the area of the reduced cross-sectional area aperture. In addition, modification of the actuation sleeve apertures that allow the drilling fluid to communicate with the actuation mechanism or movable blades may be modified. Alternatively, a wireline may be used to remove an area restriction element from the reduced cross-sectional area aperture or the sleeve aperture(s) to modify pressure response characteristics of the expandable reamer.

Further, it may be advantageous to tailor the fluid path through the tool so that the pressure response to an operational state of the expandable reamer may be amplified or made more distinctive. One possible way to do this may be to provide a port that allows drilling fluid to pass through the body of the expandable reamer upon the drilling fluid becoming communicative with a movable blade, but as the movable blade expands radially or laterally outwardly, the port becomes increasingly sealed or blocked in relation to the displacement of the movable blade toward its outermost radial or lateral position. Thus, as the movable blade moves into an expanded lateral or radial position, the port becomes increasingly sealed or blocked thereby. In turn, as the port becomes blocked, the pressure within the expandable reamer may increase, forcing the blade outwardly and causing the port to be sealed. Such a phenomenon may exhibit a "positive feedback" type of behavior, where the drilling fluid pressure causes the port to restrict the flow of drilling fluid, thus increasing the drilling fluid pressure. Therefore, the drilling fluid pressure within the expandable reamer may rapidly increase as the movable blade(s) are displaced to their outermost radial or lateral position(s). Accordingly, the relatively rapid increase in drilling fluid pressure may be desirable as being detectable and indicating that a movable blade is positioned at its outermost position. Conversely, when a blade is not fully extended, the pressure will be lower. Of course, burst discs, shear pins, pressure accumulators, or other mechanical implements may be used to amplify or distinguish the pressure response of the drilling fluid to an operational state of the expandable reamer or a movable blade thereof.

The expandable reamer of the present invention may include static as well as dynamic seals. For instance, seals may be comprised of TEFLON®, polyetheretherketone ("PEEK™") material, other plastic material, or an elastomer, or may comprise a metal-to-metal seal. Of course, dynamic seals within the tool may be disposed upon the blades as well. It may be advantageous to configure one or more backup wipers that "wipe" the surface that the seal engages. Accordingly, the one or more backup wipers may be configured with ridges that contact the surface intended to be cleaned or wiped. The one or more backup wipers may be configured to encounter the surface of engagement in the direction of movement prior to another seal or a main seal. Further, a backup wiper may also be disposed to surround a T-shaped seal, so that the T-shaped seal extends through or in between the backup wiper configuration. In such a configuration, the backup wiper may serve to inhibit the deformation and/or extrusion of the T-shaped seal.

In another aspect of the present invention, a lubricant compensator system may be included as part of any seals within the expandable reamer. Compensator systems are known in the art to be typically used within roller cone rotary drill bits for reducing the ability of drilling mud to enter the moving roller bearings within each cone. Within the present invention, a pressurized lubricant compensator system may be used to pressurize a seal or seal assembly, thus inhibiting contaminants from causing damage thereto or entering thereacross.

In another exemplary embodiment of the present invention, an oil-filled chamber and a separation element, such as a piston or membrane, may be configured so that the pressure developed by the drilling fluid may be transferred via the separation element and oil within the chamber to the movable blades. Such a configuration may protect the movable assemblies from contaminants, chemicals, or solids within the drilling fluid by transferring the drilling fluid pressure without contact of the drilling fluid with the movable blades of the expandable reamer.

In addition, at least one movable blade may be configured with a drilling fluid port to aid in cleaning the formation cuttings from the cutting elements affixed to the movable blades. In one exemplary embodiment, a drilling fluid port may be configured near the lower longitudinal cutters on the movable blade and may be oriented at an angle, for example, 15° from horizontal, toward the upper longitudinal end of the reamer. Alternatively, a drilling fluid port may be installed in the horizontal direction, perpendicular to the axis of the tool. A drilling fluid port may be located near to, or actually as a part of, an expanding blade. Other configurations for communicating fluid from the interior of the tubular body to the cutting elements on the movable blades are contemplated, including a plurality of fluid ports on at least one movable blade.

Another feature of an expandable reamer with movable blades that includes an actuation sleeve may be that, in case of a malfunction, the actuation sliding sleeve may be removed by a wireline with a fishing head configured to engage the reduced cross-sectional area orifice. Upon removal of the slidable sleeve, other operations or mechanical manipulation of the movable blades may be accomplished. Mechanisms for either actuating or returning movable blades that may be deployed by a wireline are also contemplated by the present invention. One example would be a linkage that could either force the blades radially or laterally inwardly or outwardly when provided with a force in a longitudinal direction.

Of course, many other mechanical arrangements for actuating the blades of the expandable reamer are contemplated by the present invention. For instance, the expandable reamer of the present invention may be actuated by mechanical means such as threaded elements, pistons, linkages, tapered elements or cams, or other mechanical configurations may be used. The blades may be hinged to allow for movement. Further, electromechanical actuators may be used, such as turbines, electrical motors coupled to worm gears, gears, lead screws, or other displacement equipment as known in the art. Accordingly, when controllable electromechanical means are used to actuate the movable reamer blades, a microprocessor may be used to control the position of the blades. Blade position may be controlled as a function of drilling conditions or other feedback. Also, the position of the blades may be programmed to respond to a measurable drilling condition. Thus, an expandable reamer of the present invention may be used to ream multiple desired diameters within a single borehole.

Alternatively, differently sized and/or spaced movable blades may be configured so that a first borehole diameter may be drilled at a first drilling fluid flow rate, and a second borehole diameter may be drilled at a second drilling fluid flow rate. For instance, a set of shear pins may restrain expansion of the movable blades up to a first drilling fluid pressure at a first radial or lateral position. Subsequently, drilling fluid pressure in excess of the first drilling fluid pressure may be applied to shear the set of shear pins and cause the movable blade sections to be displaced to another, more extended position. Many alternatives are contemplated for using the expandable reamer of the present invention to ream more than one size of borehole, including drilling a first larger borehole and a second smaller borehole, drilling a first smaller borehole and a second larger borehole, or simply drilling a first section of a borehole with a first plurality of movable blades configured to expand to a first diameter and a second section of the borehole with a second plurality of movable blades configured to expand to a second diameter.

In yet another exemplary embodiment, the expandable reamer of the present invention may be configured to enlarge a borehole relatively significantly. A single movable blade may be configured to expand and contract over a greater radial or lateral distance than multiple movable blades because interference between the movable blades may be eliminated. Thus, movable blades may be disposed at different axial positions and configured to radially or laterally expand and contract relatively significantly by utilizing space within the expandable reamer. Disposing movable blades at different axial positions along the axis of reaming may allow for the movable blades to extend and contract over a greater radial or lateral distance, since the interior of each movable blade may not interfere with the interior of another movable blade. Accordingly, the plenum for conducting drilling fluid may be disposed in an off-center manner if the movable blades extend into the center of the tool. In addition, more than one movable blade may be disposed at different axial and circumferential positions.

Further, the expandable reamer of the present invention may include a replaceable bearing pad disposed proximate to one end of a movable blade. Thus, in the direction of drilling/reaming, the replaceable bearing pad may longitudinally precede or follow the movable blade. Replaceable bearing pads may comprise hardfacing, diamond, tungsten carbide, or superabrasive materials. Further, a replaceable bearing pad may be configured to be affixed to and removed from the expandable reamer by way of removable lock rods extending along a longitudinal area of an expandable reamer as described hereinabove.

In addition, the expandable reamer of the present invention may include movable bearing pad sections that may be expanded radially or laterally outward under selectable operating conditions and are configured (if expanded) to engage the pilot borehole so as to stabilize the expandable reamer during reaming operations. The movable bearing pad sections may be actuated at substantially the same operating conditions as the movable blades of an expandable reamer or, alternatively, at differing operating conditions. It may be advantageous for the bearing pad sections to expand to their outermost radial or lateral position prior to the movable blades being actuated to their outermost radial or lateral position so as to stabilize the blades during their initial contact with the pilot borehole as well as during subsequent reaming operations. The expandable bearing-pad-sections may include biasing elements for returning the bearing pad sections to their innermost radial or lateral positions under selectable conditions. Movable elements may be adjustable from the outer surface of the tubular body of the expandable reamer to provide field-settable capabilities.

Although drilling fluid pressure may be the most available source for actuating movable blades and bearing pads, alternative sources are contemplated. For instance, it may be desirable to power an expandable reamer of the present invention by way of a downhole pump or turbine-generated electrical power. Downhole pumps or turbines may allow for an expandable reamer to be used when the flow rates and pressures that are required to actuate the tool are not available or desirable. Further, expansion or contraction of the movable blades of the expandable reamer of the present invention may be triggered by an external signal or condition such as a series of pressure pulses in the drilling fluid. Also, the movable blades may be actuated by weight-on-bit (WOB) force, torque, rotational forces, electrical energy, explosive charges or other energy sources.

Similarly, many different configurations may be employed for allowing drilling fluid pressure to communicate with movable blades of the present invention. The sliding sleeve actuation mechanism may be replaced with a hydraulic valve. In such a configuration, a sleeve may be used to separate the drilling fluid from the actuation fluid, the actuation fluid supplied by way of a turbine or other pressure-developing apparatus. Moreover, an electrically actuated valve may be configured to deploy a downhole motor, pump, or turbine that supplies drilling fluid pressure to the expandable reamer of the present invention, thus potentially eliminating the need for a sliding sleeve actuation mechanism.

Regardless of the actuation means for displacing the movable blades or bearing pads within the expandable reamer, the reamer may be configured so that the blades or bearing pads may be locked into a position. The locked position may be fully expanded or expanded to an intermediate position. Locking elements may slide in response to increasing drilling fluid pressure, or may comprise a tapered fit between a sliding element and the movable blades, or a locking mechanism such as linkages that engage the movable blades. Other locking mechanisms may be used as are known in the art.

Antiwhirl features as known in the art may be employed by the expandable reamer of the present invention. U.S. Pat. No. 5,495,899, assigned to the assignee of the present invention, describes a reaming wing assembly with antiwhirl features. More specifically, one of the movable blades may be configured to be a bearing surface, where the vector summation of the cutting element forces may be directed toward the bearing blade section. Accordingly, it may be advantageous to preferentially align the antiwhirl characteristics of the expandable reamer with the antiwhirl characteristics of the pilot bit. For instance, it may be advantageous to align the antiwhirl bearing pad of the expandable reamer with the antiwhirl bearing pad of the pilot bit.

The movable blades included within the expandable reamer of the present invention may be circumferentially symmetric, wherein each movable blade may be disposed at evenly spaced circumferential positions. Circumferentially asymmetric blade arrangements may also be employed, wherein movable blades may be placed at unevenly spaced circumferential positions. Asymmetric movable blade arrangements may require that blades exhibit different radial or lateral displacements so that each blade may be expanded to substantially identical outer radial or lateral extents.

Movable blades may be fabricated from steel or tungsten carbide matrix material, as known in the art. Steel movable blades may be hardfaced to increase their erosion and abrasion resistance. In addition, the expandable reamer of the present invention may include blades having chip breakers, typically used when drilling bit-balling shale formations, embodying a raised area on the blade surface proximate to the cutting elements for effecting improved cuttings removal. The raised area of the chip breaker causes a formation chip being cut to be forced away from the blade surface, thereby causing the formation chip to break away from the blade. The chip breaker may be a ramped surface, such as the ramped surface of the chip breakers disclosed in U.S. Pat. No. 5,582,258, assigned to the assignee of the present invention, and may include a protrusion positioned proximate each cutting element on the surface of the bit face such that, as a formation shaving slides across the cutting face of the cutting element, the protrusion splits and/or breaks up the chip into two or more segments as disclosed in U.S. Pat. No. 6,328,117, also assigned to the assignee of the present invention. Moreover, the expandable reamer of the present invention may be coated with a coating to enhance its durability or with a non-stick coating to reduce balling characteristics.

Features from any of the above-mentioned embodiments may be used in combination with one another in accordance with the present invention. Other features and advantages of the present invention will become apparent to those of ordinary skill in the art through consideration of the ensuing description, the accompanying drawings, and the appended claims.

BRIEF DESCRIPTION OF THE DRAWINGS

In the drawings, which illustrate what is currently considered to be the best mode for carrying out the invention:

FIG. 1D1 is a perspective schematic view of one embodiment of a movable blade-retention apparatus and FIG. 1D2 is a partial sectional perspective schematic taken transverse to the longitudinal extent of the movable blade-retention apparatus of FIG. 1D1;

DETAILED DESCRIPTION OF THE INVENTION

Figure 1A:
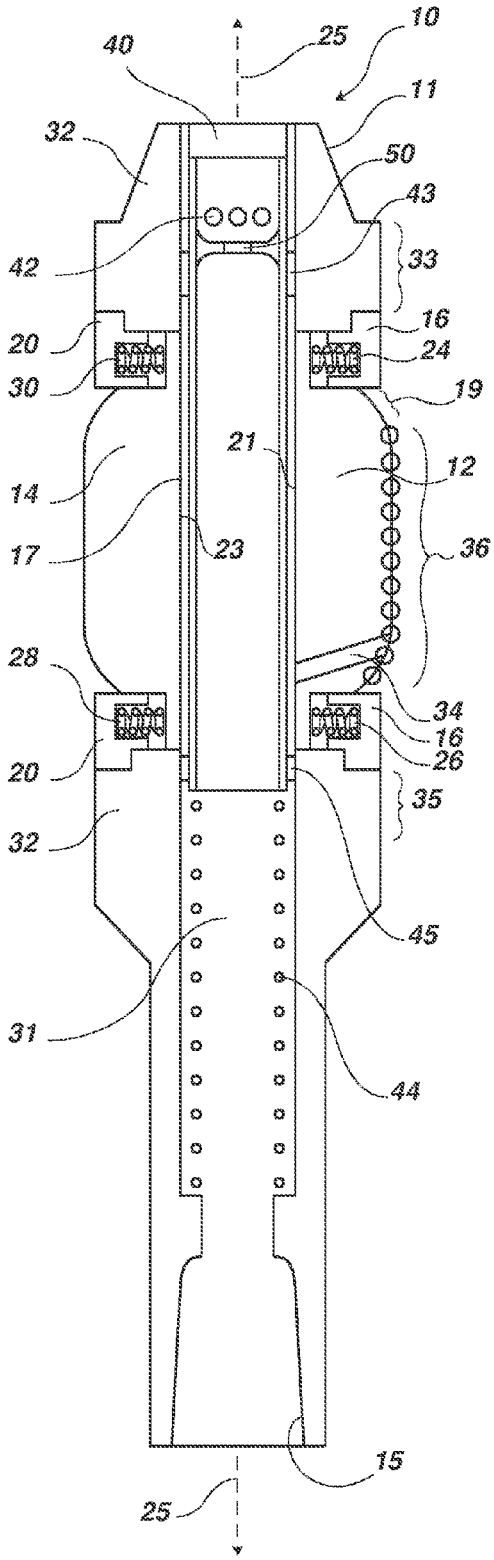
FIG. 1A is a conceptual side cross-sectional view of an expandable reamer of the present invention in a contracted state.
Figure 1B:
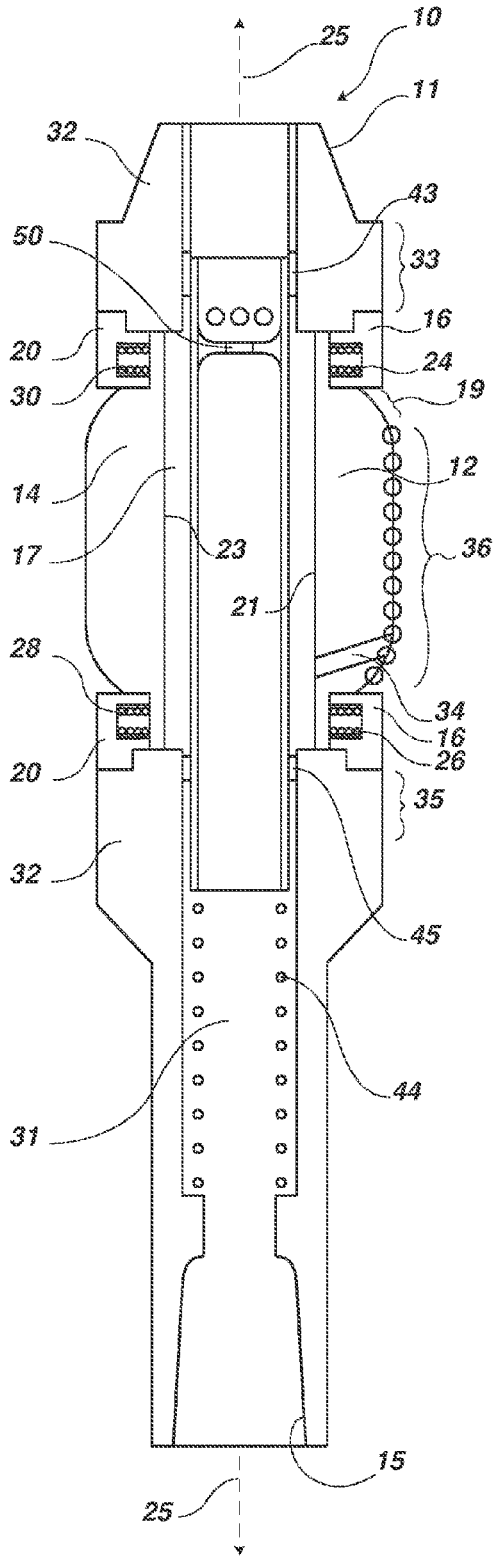
FIG. 1B is a conceptual side cross-sectional view of an expandable reamer of the present invention in an expanded state.

Referring to FIGS. 1A and 1B of the drawings, each shows a conceptual schematic side view of an expandable reamer 10 of the present invention. Expandable reamer 10 includes a tubular body 32 with a bore 31 extending therethrough, having movable blades 12 and 14 outwardly spaced from a centerline or longitudinal axis 25 of the tubular body 32. Tubular body 32 includes a male-threaded pin connection 11 as well as a female-threaded box connection 15, as known in the art. Movable blades 12 and 14 may each carry a plurality of cutting elements 36. Cutting elements 36 are shown only on movable blade 12, as the cutting elements on movable blade 14 would be facing in the direction of rotation of the expandable reamer 10 and, therefore, may not be visible in the view depicted in FIG. 1A. Cutting elements 36 may comprise PDC cutting elements, thermally stable PDC cutting elements (also known as "TSPs"), superabrasive impregnated cutting elements, tungsten carbide cutting elements, and any other known cutting element of a material and design suitable for the subterranean formation through which a borehole is to be reamed using expandable reamer 10. One particularly suitable superabrasive impregnated cutting element is disclosed in U.S. Pat. No. 6,510,906, the disclosure of which is incorporated herein by reference. It is also contemplated that, if PDC cutting elements are employed, they may be positioned on a blade so as to be circumferentially and rotationally offset from a radially outer, rotationally leading edge portion of a blade where a casing contact point is to occur. Such positioning of the cutters rotationally, or circumferentially, to the rotational rear of the casing contact point located on the radially outermost leading edge of the blade allows the cutters to remain on proper drill diameter for enlarging the borehole, but are, in effect, recessed away from the casing contact point.

Such an arrangement is disclosed and claimed in U.S. Pat. No. 6,695,080, the disclosure of which is incorporated herein by reference.

In FIG. 1A, the expandable reamer 10 is shown in a contracted state, where the movable blades 12 and 14 are positioned radially or laterally inwardly. As shown in FIG. 1A, the outermost radial or lateral extent of movable blades 12 and 14 may substantially coincide with or not exceed the outer diameter of the tubular body 32. Such a configuration may protect cutting elements 36 as the expandable reamer 10 is disposed within a subterranean borehole. Alternatively, the outermost radial or lateral extent of movable blades 12 and 14 may exceed or fall within the outer diameter of tubular body 32.

Actuation sleeve 40 may be positioned longitudinally in a first position, where apertures or ports 42 are above actuation seal 43. Drilling fluid (not shown) may pass through actuation sleeve 40, thus passing by movable blades 12 and 14. Actuation seal 43 and lower sleeve seal 45 may prevent drilling fluid from interacting with movable blades 12 and 14. Further, sleeve-biasing element 44 may provide a bias force to actuation sleeve 40 to maintain its longitudinal position. However, as drilling fluid passes through actuation sleeve 40, a reduced cross-sectional orifice 50 may produce a force upon the actuation sleeve 40. As known in the art, drag of the drilling fluid through the reduced cross-sectional orifice 50 may cause a downward longitudinal force to develop on the actuation sleeve 40. As the drilling fluid force on the actuation sleeve 40 exceeds the force generated by the sleeve-biasing element 44, the actuation sleeve 40 may move longitudinally downward thereagainst. Thus, the longitudinal position of the actuation sleeve 40 may be modified by way of changing the flow rate of the drilling fluid passing therethrough. Alternatively, a collet or shear pins (not shown) may be used to resist the downward longitudinal force until the shear point of the shear pin or frictional force of the collet is exceeded. Thus, the downward longitudinal force generated by the drilling fluid moving through the reduced cross-sectional orifice 50 may cause a frangible or frictional element to release the actuation sleeve 40 and may cause the actuation sleeve 40 to move longitudinally downward.

Further, the longitudinal position of the actuation sleeve 40 may allow drilling fluid to be diverted to inner surfaces 21 and 23 of movable blades 12 and 14, respectively, via apertures or ports 42. In opposition to the force of the drilling fluid upon the inner surfaces 21 and 23 of movable blades 12 and 14, blade-biasing elements 24, 26, 28, and 30 may be configured to provide an inward radial or lateral force upon movable blades 12 and 14. However, drilling fluid acting upon the inner surfaces 21 and 23 may generate a force that exceeds the force applied to the movable blades 12 and 14 by way of the blade-biasing elements 24, 26, 28, and 30, and movable blades 12 and 14 may, therefore, move radially or laterally outwardly. Thus, expandable reamer 10 is shown in an expanded state in FIG. 1B, wherein movable blades 12 and 14 are disposed at their outermost radial or lateral position.

Thus, FIG. 1B shows an operational state of expandable reamer 10 wherein actuation sleeve 40 is positioned longitudinally so that apertures or ports 42 allow drilling fluid flowing through expandable reamer 10 to pressurize an annulus 17 formed between the outer surface of actuation sleeve 40 and inner surfaces 21 and 23 of movable blades 12 and 14 to force movable blade 12 against blade-biasing elements 24 and 26, as well as forcing movable blade 14 against blade-biasing elements 28 and 30. Further, the pressure applied to the inner surfaces 21 and 23 may be sufficient so that movable blade 12 compresses blade-biasing elements 24 and 26 and may matingly engage the inner radial surface of retention element 16 as shown in FIG. 1B. Regions 33 and 35 indicate a portion of the tubular body 32 that may contain holes for disposing removable lock rods (not shown), as described in FIG. 1D1, for affixing retention element 16 and movable blade 12 thereto. Likewise, the pressure applied to the inner surfaces 21 and 23 may be sufficient so that movable blade 14 compresses blade-biasing elements 28 and 30 and may matingly engage the radial inner surface of retention element 20 as shown in FIG. 1B. Thus, the movable blades 12 and 14 of expandable reamer 10 of the present invention may be caused to expand to an outermost radial or lateral position and the borehole may be enlarged by the combination of rotation and longitudinal displacement of the expandable reamer 10.

Further, at least one movable blade 12 of the expandable reamer 10 may be configured with a port 34 to aid in cleaning the formation cuttings from the cutting elements 36 affixed to the movable blades 12 and 14 during reaming. As shown in FIGS. 1A and 1B, a port 34 may be configured near the lower longitudinal cutting elements 36 on movable blade 12 and may be oriented, for example, 15° from horizontal, toward the upper longitudinal end of the expandable reamer 10. Alternatively, a port 34 may be installed in the horizontal direction, substantially perpendicular to the longitudinal axis 25 of tubular body 32 of the expandable reamer 10. Of course, the present invention contemplates that a port 34 may be oriented as desired. Other configurations for communicating fluid from the interior of the tubular body 32 to the cutting elements 36 on the movable blades 12 and 14 are contemplated, including a plurality of ports 34 on at least one movable blade.

Movable blades 12 and 14 may also be caused to contract radially or laterally. For instance, as the drilling fluid pressure decreases, blade-biasing elements 24, 26, 28, and 30 may exert a radial or lateral inward force to bias movable blades 12 and 14 radially or laterally inward. In addition, taper 19 may facilitate movable blades 12 and 14 returning radially or laterally inwardly during tripping out of the borehole if the blade-biasing elements 24, 26, 28, and 30 fail to do so. Specifically, impacts between the borehole and the taper 19 may tend to move the movable blades 12 and 14 radially or laterally inward.

Figure 1C:
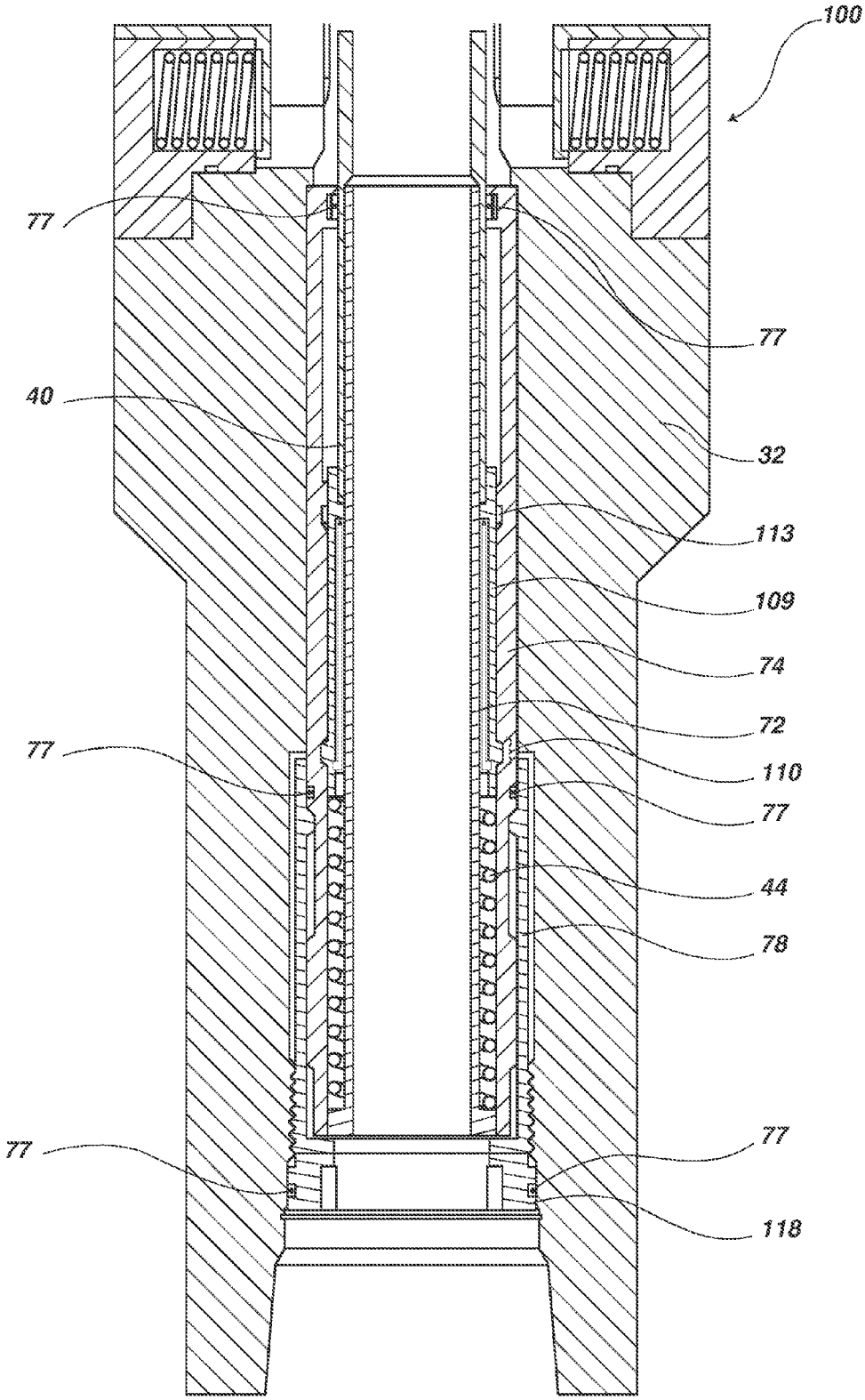
FIG. 1C is a partial cross-sectional view of the lower longitudinal end of an expandable reamer of the present invention.

FIG. 1C shows a partial cross-sectional view of the lower longitudinal end of an expandable reamer 100 of the present invention including an actuation sleeve-biasing element 44. As may be seen in FIG. 1C, inner sleeve stop 72, outer housing 74, transfer sleeve 109, actuation sleeve-biasing element 44, lower retainer 78, end cap 118, and various sealing elements 77 may be disposed within the lower longitudinal bore of the tubular body 32 of the expandable reamer 100. Expandable reamer 100 may be configured with an actuation sleeve 40 having a reduced cross-sectional orifice 50 (not shown) as depicted in FIGS. 1A and 1B, wherein a drilling fluid passing therethrough may cause actuation sleeve 40 to be displaced longitudinally downward. Accordingly, as shown in FIG. 1C, the lower longitudinal end of actuation sleeve 40 is shown as matingly engaging transfer sleeve 109. In turn, the transfer sleeve 109 may compress actuation sleeve-biasing element 44, thus providing a returning force upon the actuation sleeve 40. Actuation sleeve 40 may be prevented from further longitudinal displacement by way of mating engagement of inner sleeve stop 72 at its upper longitudinal end. Further, upper indentation 113 and lower indentation 110 formed within the outer housing 74 may selectively position or retain the transfer sleeve 109 according to the forces thereon and the position of the lower longitudinal end thereof, which may be complementary in its geometry in relation to the geometry of indentations 113 and 110 as shown. Therefore, the expandable reamer 100 of the present invention may be configured to allow the actuation sleeve 40 to be selectively positioned and biased. Many other configurations for limiting or selectively positioning the actuation sleeve 40 of the present invention may be utilized, including collets, pins, frangible elements, seating surfaces, or other elements of mechanical design as known in the art.

FIGS. 1D1 and 1D2 show an embodiment of a movable blade-retention apparatus 201 consistent with the embodiments of expandable reamer 10, as shown in FIGS. 1A and 1B, wherein removable lock rods 203 extend longitudinally along the tubular body 32 of the expandable reamer 10 at different circumferential placements, respectively. Retention block 206 may be formed as an integral part of the tubular body 32, or may be welded onto the tubular body 32. As shown in FIG. 1D1, removable lock rods 203 are partially extending into holes 205 within retention block 206 formed within regions 33 and 35 (also depicted in FIGS. 1A and 1B), the inner portions of holes 205 being in alignment with grooves 205*a* on the interior of retention block 206 (see FIG. 1D2), and further matingly engaging grooves 205*b* (see FIG. 1D2) extending longitudinally along the exterior of retention element 16 to retain movable blade 12. More specifically, holes 205 formed in the tubular body 32 in the regions 33 and 35, as shown in FIGS. 1A and 1B, allow for removable lock rods 203 to be inserted therethrough, extending between retention element 16 and retention block 206, thus affixing retention element 16 to tubular body 32. When fully installed, removable lock rods 203 extend substantially the length of retention block 206, but may extend further, depending on how the removable lock rods 203 are affixed to the retention block 206. Removable lock rods 203 may be threaded, splined, pinned, welded or otherwise affixed to the retention block 206. Of course, in one embodiment, removable lock rods 203 may be detached from the retention block 206 to allow for removal of retention element 16 as well as movable blade 12. Accordingly, the present invention contemplates that a retention element and/or a movable blade of the expandable reamer may be removed, replaced, or repaired by way of removing the removable lock rods 203 from the holes 205 within the tubular body 32 of the expandable reamer 10. Of course, many alternative removable retention configurations are possible, including pinned elements, threaded elements, dovetail elements, or other connection elements known in the art to retain movable blade 12. Movable blade 14 and/or any other movable blades may be retained in a similar manner. Also depicted in FIG. 1D2 is circumferential seal assembly 207 carried in groove 209 on the exterior of movable blade 12 to prevent debris and contaminants from the wellbore from entering the interior of expandable reamer 10.

As may also be seen in FIGS. 1D1 and 1D2, the cross-sectional shape of the movable blade 12 as it extends through the retention element 16 may be oval or elliptical. Such a shape may prevent binding of the movable blade 12 as it is moved laterally inwardly and outwardly during use. Thus, the shape of the longitudinal sides of the movable blades 12 and 14 may not be straight. For instance, each longitudinal side of a movable blade may comprise an oval, elliptical, or other arcuate shape. Further, the sides need not be symmetrical, but may be if symmetry is desirable.

Figure 1E:
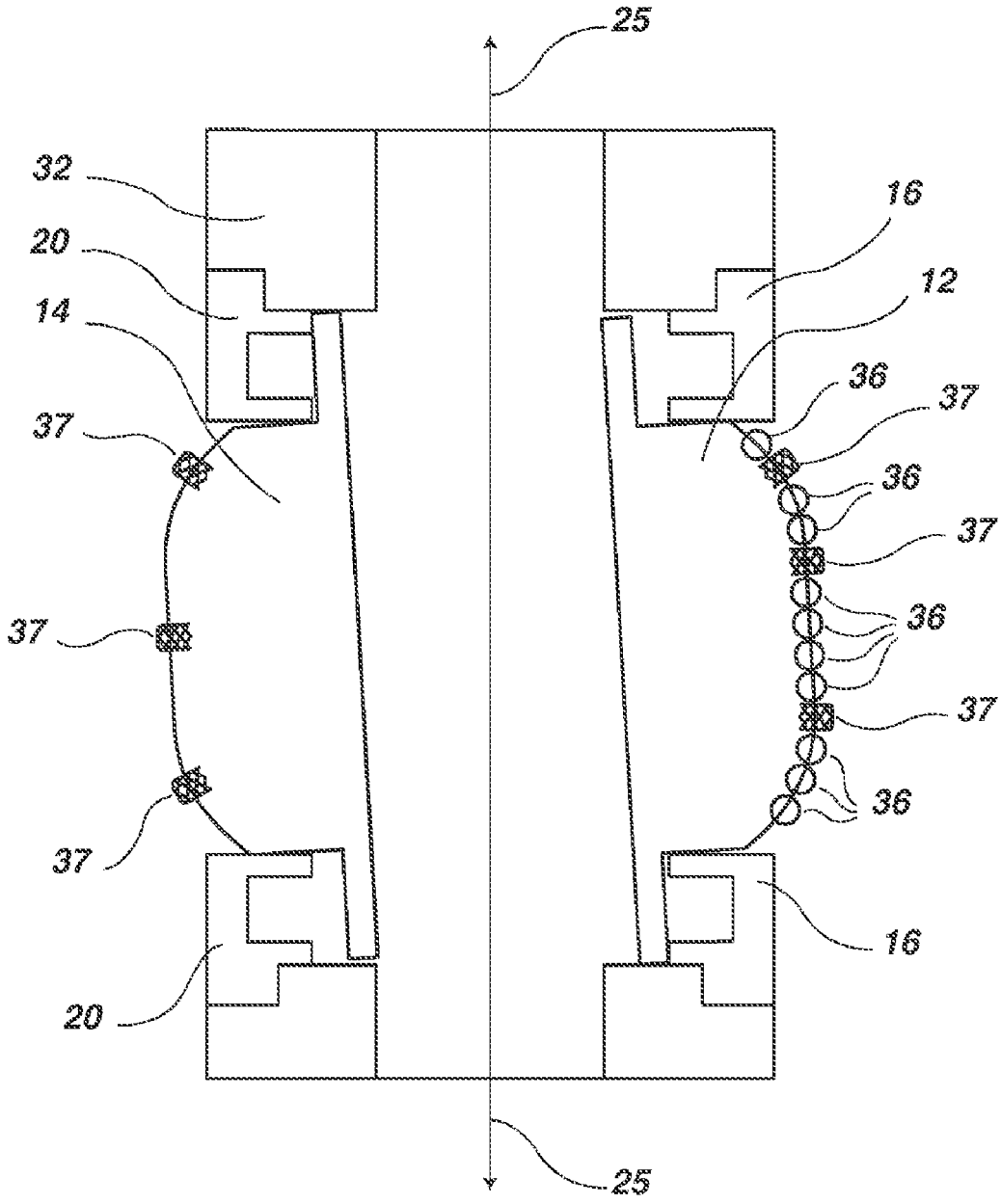
FIG. 1E is a partial conceptual side cross-sectional view of movable blades including ovoid structures of the present invention.

As shown in FIG. 1E, the present invention also contemplates that ovoid structures 37 may be employed upon movable blades 12 and 14 in order to inhibit cutting elements 36 from being damaged due to excessive or undesirable contact with the borehole. FIG. 1E also shows that ovoid structures 37 may be disposed along the outer radial or lateral extent of movable blades 12 and 14 retained within tubular body 32 by way of retention elements 16 and 20, respectively. Cutting elements 36 are not shown on movable blade 14 for clarity, as such cutting elements 36 may be facing in the direction of rotation of the movable blades 12 and 14. However, on both movable blades 12 and 14, ovoid structures 37 may be desirable as inhibiting or preventing damage to associated cutting elements 36 disposed thereon, respectively.

Ovoid structures 37 may comprise a sintered tungsten carbide compact having a domed or ovoidal top surface. However, ovoid structures 37 may comprise generally or partially planar or flat, cylindrical, conical, spherical, rectangular, triangular, or arcuate shapes, and/or be otherwise geometrically configured and suitably located to provide protection to associated cutting elements 36. The present invention is not limited only to sintered tungsten carbide ovoid structures; ovoid structures may comprise other metals, sintered metals, alloys, diamond, or ceramics.

In one example, under certain orientations of the expandable reamer or the movable blades, cutting elements 36 disposed on the movable blades 12 and 14 may engage the sidewall of the borehole in an undesirable fashion. Thus, cutting elements 36 may be damaged by prematurely or excessively contacting the sidewall of the borehole. Ovoid structures 37 disposed along the movable blades 12 and 14 may inhibit or prevent excessive or premature contact between the sidewall of the borehole and the cutting elements 36 on the movable blades 12 and 14.

As shown in FIG. 1E, damage to cutting elements 36 may occur when movable blades 12 and 14 may become oriented so that the upper longitudinal ends thereof are at different lateral positions than the lower longitudinal ends thereof, respectively. Put another way, a movable blade may longitudinally tilt or rotate, as shown in relation to longitudinal axis 25 of the tubular body 32 of the expandable reamer. Movable blade 12 is longitudinally tilted so that its upper longitudinal end is closer to longitudinal axis 25 than its lower longitudinal end. Thus, the cutting elements 36 disposed on the upper longitudinal region of movable blade 12 may excessively or undesirably contact the sidewall of the borehole and become damaged in the absence of ovoid structures 37. Moreover, movable blade 14 is shown in an orientation where its upper longitudinal end is more distant from longitudinal axis 25 than its lower longitudinal end. Therefore, in the absence of ovoid structures 37, cutters (not shown) on the lower longitudinal end of movable blade 14 may become damaged due to excessive or undesirable contact with the sidewall of the borehole.

More particularly, ovoid structures 37 may be sized and positioned to initially exhibit substantially the same exposure as cutting elements 36 proximate thereto. However, ovoid structures 37 may also exhibit a relatively lower wear resistance to the formation. Thus, upon initially disposing the expandable reamer 10 within the borehole, the ovoid structures 37 may wear away, thus allowing the cutting elements 36 to assume a selected depth-of-cut into the formation. This may be advantageous because the ovoid structure 37 may prevent initial impact loading by making contact with the borehole or other surface at substantially the same exposure as the cutting elements 36 proximate thereto. Further, the ovoid structures 37, upon wearing, may limit contact between cutting elements 36 proximate thereto and the formation according to the amount of wear thereon. Additionally, cutting elements 36 and associated ovoid structures 37 may be replaced and ground (if necessary) to a desirable exposure, respectively.

The present invention contemplates that ovoid structures 37 may also inhibit excessive contact between associated cutters and the formation during unstable motion of the expandable reamer, i.e., whirling or when the expandable reamer is rotated inside the casing. Thus, movable blades 12 and 14 need not exhibit particular orientations or be tilted in order to benefit from ovoid structures 37. Ovoid structures 37 may be utilized within any of the embodiments described herein, without limitation. FIG. 1E is merely illustrative of one possible circumstance where ovoid structures 37 may prevent damage to associated cutting elements 36, and many other circumstances may exist and are contemplated by the present invention.

Figure 1F:
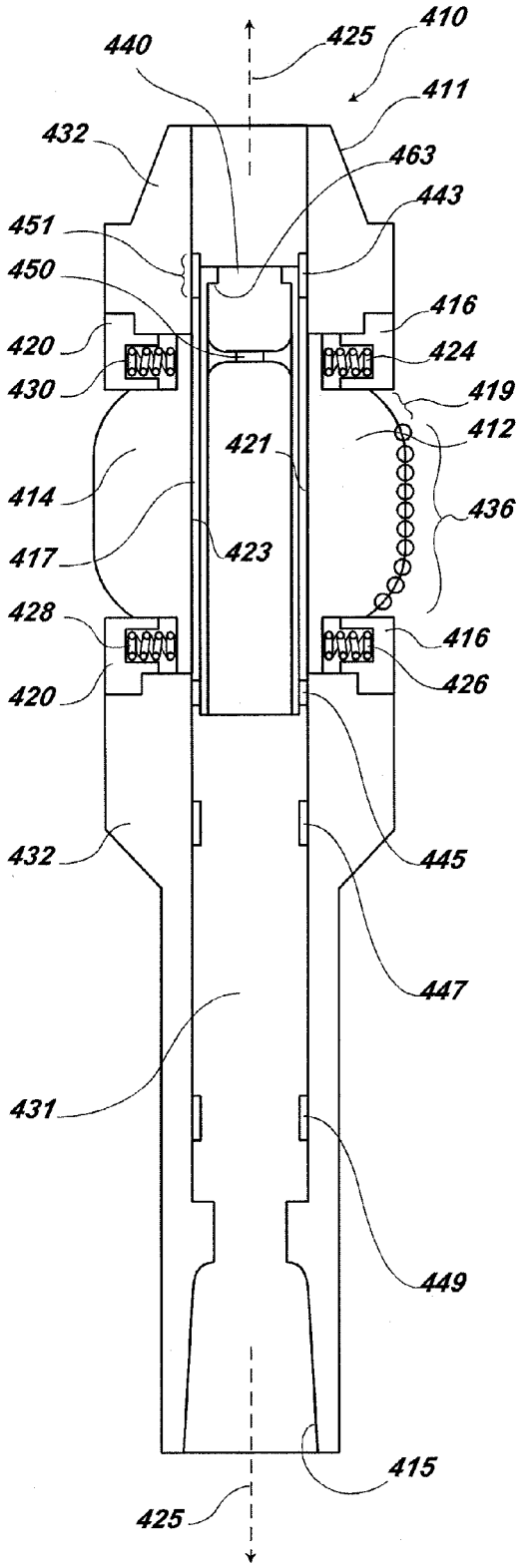
FIG. 1F is a conceptual side cross-sectional view of an expandable reamer of the present invention in a contracted state.
Figure 1G:
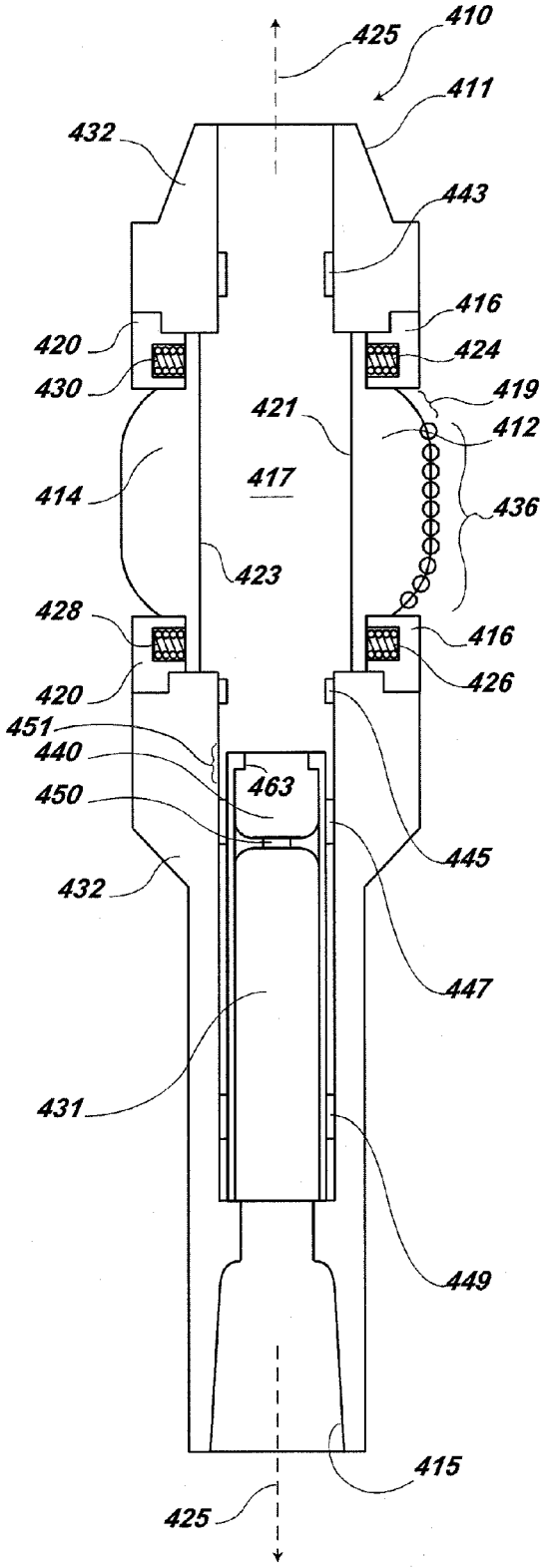
FIG. 1G is a conceptual side cross-sectional view of an expandable reamer of the present invention in an expanded state.

As a further embodiment of the present invention, expandable reamer 410 is shown in FIGS. 1F and 1G, wherein an actuation sleeve 440 may be configured to pass substantially longitudinally past the lower longitudinal extent of movable blades 412 and 414 upon actuation thereof. FIGS. 1F and 1G illustrate an embodiment of the expandable reamer 410 of the present invention, wherein actuation sleeve 440 may be used to actuate the movable blades 412 and 414. Expandable reamer 410 includes a tubular body 432 with a bore 431 extending therethrough and movable blades 412 and 414 outwardly spaced from the centerline or longitudinal axis 425 of the tubular body 432, wherein each movable blade 412 and 414 may carry a plurality of cutting elements 436, as known in the art. Tubular body 432 also includes a male-threaded pin connection 411 as well as a female-threaded box connection 415. Cutting elements 436 are shown only on movable blade 412 for clarity, as the cutters on movable blade 414 may be typically facing in the direction of rotation of the tubular body 432 and, therefore, may not be visible in the view depicted in FIGS. 1F and 1G.

As depicted in FIG. 1F, the expandable reamer 410 is shown in a contracted state, wherein the movable blades 412 and 414 are positioned radially or laterally inwardly. Actuation sleeve 440 may be positioned longitudinally in a first position near the upper longitudinal end of the tubular body 432, so that the exterior of an upper end 451 of the actuation sleeve 440 is positioned to seal against an actuation seal 443. Further, actuation seal 443 and lower sleeve seal 445 may seal against the actuation sleeve 440. Thus, drilling fluid (not shown) may pass through actuation sleeve 440 without communicating with inner surfaces 421 and 423 of movable blades 412 and 414, respectively, so long as the actuation sleeve 440 is appropriately longitudinally positioned by way of shear pins, interlocking members, frictional elements, collets, frangible members, or otherwise as known in the art.

Actuation sleeve 440 may include a reduced cross-sectional orifice 450, which, in turn, may produce a downward longitudinal force as drilling fluid passes therethrough. Upon sufficient downward longitudinal force developing, the actuation sleeve 440 may be displaced longitudinally, as shown in FIG. 1G, and may be guided by bushing elements 447 and 449. Longitudinal displacement of actuation sleeve 440 may allow drilling fluid to act upon the movable blades 412 and 414 and may cause movable blades 412 and 414 to expand radially or laterally outwardly, matingly engaging retention elements 416 and 420, respectively, as shown in FIG. 1G, against the opposing forces of blade-biasing elements 424, 426, 428, and 430. Therefore, the expandable reamer 410 as depicted in FIGS. 1F and 1G may be a "one-shot" tool, wherein operation without drilling fluid communication to the movable blades 412 and 414 may not be possible without resetting the actuation sleeve 440 position as shown in FIG. 1F. Alternatively, actuation sleeve lip 463 may be configured to engage a wireline tool (not shown) in order to apply an upward longitudinal force to the actuation sleeve 440 and position the actuation sleeve 440 to the longitudinal position shown in FIG. 1F from the longitudinal position shown in FIG. 1G. Of course, movable blades 412 and 414 may return radially or laterally inwardly as the forces applied thereto by way of blade-biasing elements 424 and 426, as well as 428 and 430, respectively, exceed the forces of the drilling fluid upon the inner surfaces 421 and 423 of movable blades 412 and 414, respectively. In addition, taper 419 may encourage radially or laterally inward movement of movable blades 412, 414 by interaction with the borehole or casing.

By configuring the expandable reamer 410 with an actuation sleeve 440 that may be displaced substantially the longitudinal length of the movable blades 412 and 414, several advantages may be realized. For instance, as may be seen in FIG. 1F, contraction of the movable blades 412 and 414 may not be hindered by minor debris within relatively large bore 417. Comparatively, the relative size of annulus 17 (shown in FIGS. 1A and 1B) between the actuation sleeve 40 and the inner surfaces 21 and 23 of movable blades 12 and 14 may impede refraction of the movable blades 12 and 14, especially where debris exists therein.

Figure 1H:
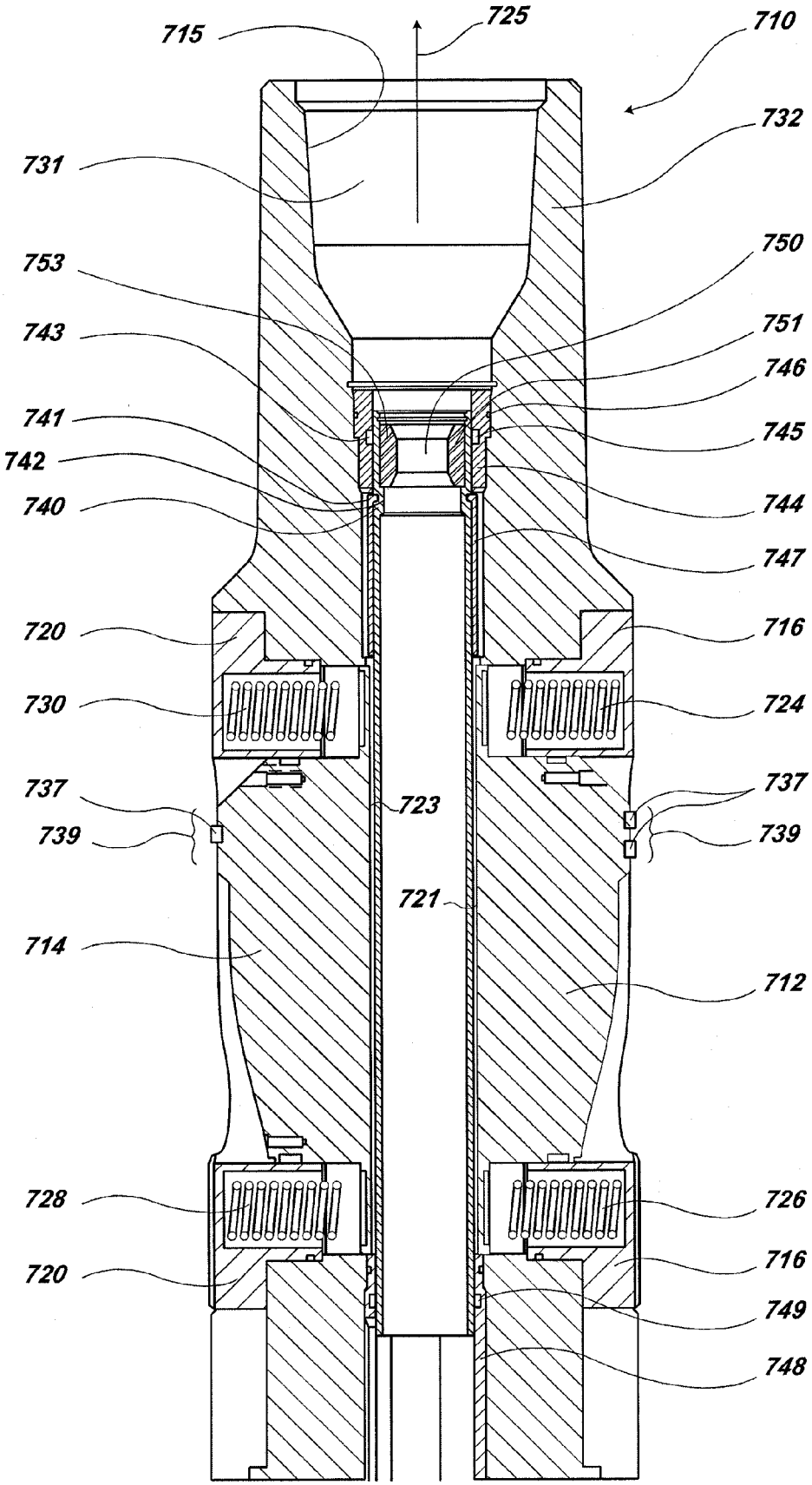
FIG. 1H is a side cross-sectional view of the upper longitudinal region of another embodiment of an expandable reamer of the present invention in a contracted state.

FIG. 1H shows the upper longitudinal region of another embodiment of an expandable reamer 710, wherein an actuation sleeve 740 may be configured to longitudinally pass through a longitudinal region occupied by movable blades 712 and 714. Expandable reamer 710 includes a tubular body 732 with bore 731 extending therethrough and movable blades 712 and 714 outwardly spaced from the centerline or longitudinal axis 725 of the tubular body 732. Each movable blade 712 and 714 may carry a plurality of cutting elements (not shown for clarity). Further, movable blades 712 and 714 may carry at least one ovoid structure 737. Ovoid structures 737 are shown in FIG. 1H within gage areas 739 of the movable blades 712 and 714 for protecting associated cutting elements (not shown) proximate thereto. Tubular body 732 also includes a female-threaded box connection 715 at its upper longitudinal end and a male-threaded pin connection 711 (see FIG. 1I) at its lower longitudinal end.

Figure 1I:
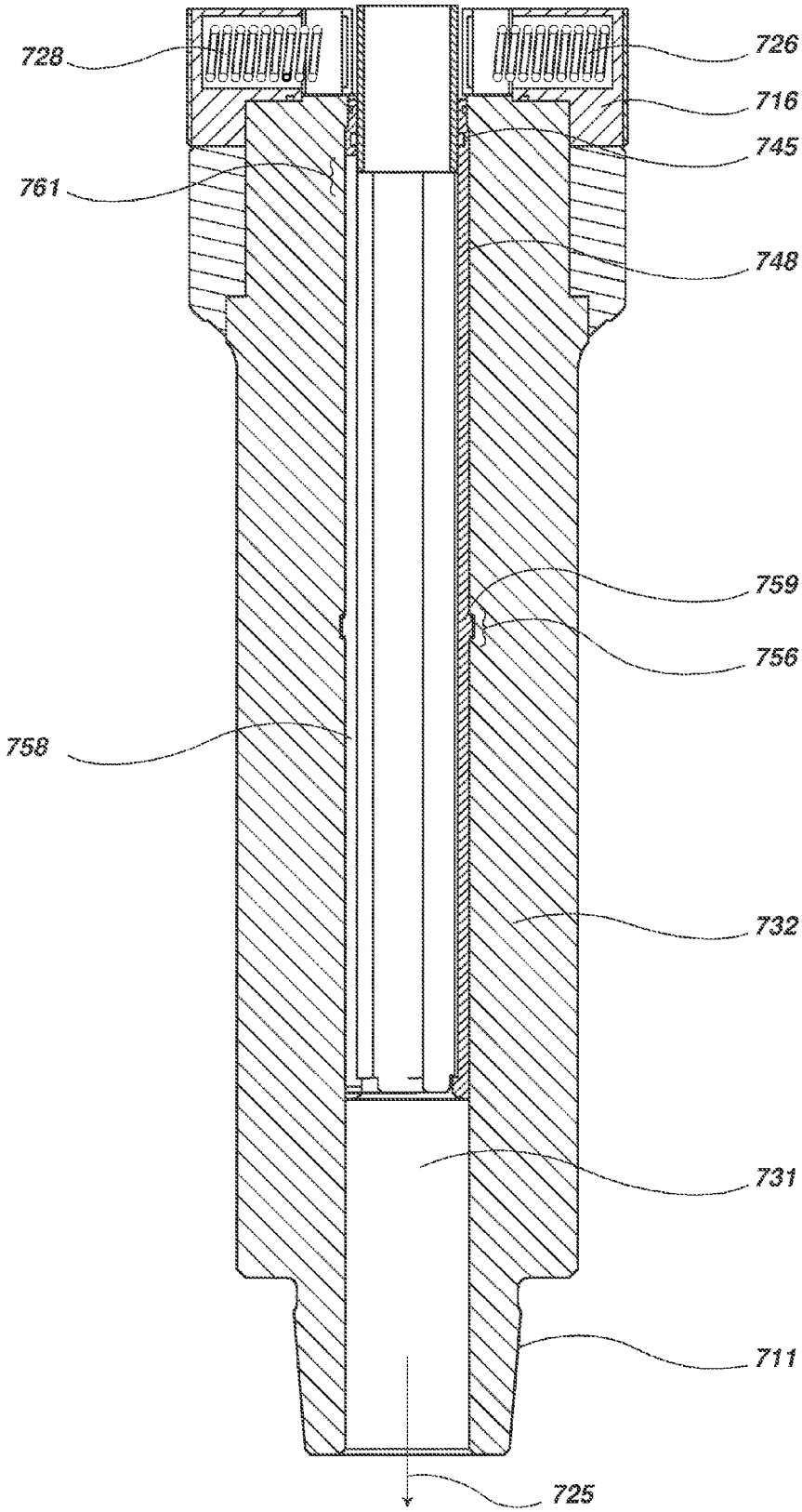
FIG. 1I is a side cross-sectional view of the lower longitudinal region of the expandable reamer shown in FIG. 1H.

Expandable reamer 710, as depicted in FIGS. 1H and 1I, is shown in a contracted state, wherein the movable blades 712 and 714 are positioned radially or laterally inwardly. Actuation sleeve 740, as shown in FIG. 1H, is positioned longitudinally near the upper longitudinal end of the tubular body 732. Upper sleeve housing 744 may include inner seal element 745 in annular recess 743 for sealing against the actuation sleeve 740 as well as outer seal element 746 for sealing against the interior of tubular body 732. In addition, lower sleeve seal 749 disposed within retaining sleeve 748 may be configured for sealing against the actuation sleeve 740. Accordingly, as shown in FIG. 1H, drilling fluid (not shown) may pass through actuation sleeve 740 while substantially sealed from communication with movable blades 712 and 714.

Actuation sleeve 740 may include a reduced cross-sectional orifice 750 and may be displaced longitudinally in a fashion similar to the embodiments described hereinabove, in that drilling fluid flowing therethrough may produce a longitudinally downward force on the actuation sleeve 740. FIG. 1H also illustrates that an orifice body 751 may include reduced cross-sectional orifice 750 sealed within actuation sleeve 740 by way of orifice body seal 753. Thus, the orifice body 751 and associated reduced cross-sectional orifice 750 may be replaced or modified by removing orifice body 751 from the interior of the actuation sleeve 740. Collet sleeve 747 having a male feature 741 fitting into a complementary female feature 742 within the actuation sleeve 740 may retain actuation sleeve 740 in its position as shown in FIG. 1H until the longitudinally downward force generated by way of the flow of drilling fluid through the reduced cross-sectional orifice 750 exceeds the retaining force supplied thereby.

Longitudinal displacement of actuation sleeve 740 below inner seal element 745 may allow drilling fluid to act upon inner surfaces 721 and 723 of movable blades 712 and 714, respectively, causing them to expand radially or laterally outwardly against the opposing forces of blade-biasing elements 724 and 726, as well as 728 and 730, retained by retention elements 716 and 720, respectively. Of course, movable blades 712 and 714 may return radially or laterally inwardly as the forces applied thereto by way of blade-biasing elements 724 and 726, as well as 728 and 730, respectively, exceed the forces of the drilling fluid upon the inner surfaces 721 and 723 of movable blades 712 and 714, respectively.

As may further be seen with respect to FIG. 1I, retaining sleeve 748 is sized and configured so that the actuation sleeve 740 may be disposed longitudinally therein. Therefore, upon sufficient force, the actuation sleeve 740 may be longitudinally displaced so that its lower longitudinal end matingly engages the longitudinally lower end of the retaining sleeve 748. In such a position, the actuation sleeve 740 may not coincide with any portion of the longitudinal extent of movable blades 712 and 714 (see FIG. 1H). As mentioned hereinabove, such a configuration may facilitate movable blades 712 and 714, once expanded, to return radially or laterally inwardly. Retaining sleeve 748 may be prevented from longitudinal movement by way of indentation 756 and complementary male feature 759 disposed therein. Further, as shown in FIG. 1I, retaining sleeve 748 may include longitudinal slots 758 configured to increase the flow area available for drilling fluid passing through the expandable reamer 710. More specifically, the actuation sleeve 740 may be disposed within the retaining sleeve 748, such that drilling fluid may pass through both the reduced cross-sectional orifice 750 and the longitudinal slots 758. One way to do so would be to configure the lengths of the actuation sleeve 740 and the retaining sleeve 748 so that the longitudinal upper surface of the actuation sleeve 740 is positioned below the upper extent 761 of the longitudinal slots 758. Such a configuration may improve the drilling fluid flow characteristics of the expandable reamer 710.

Figure 2A:
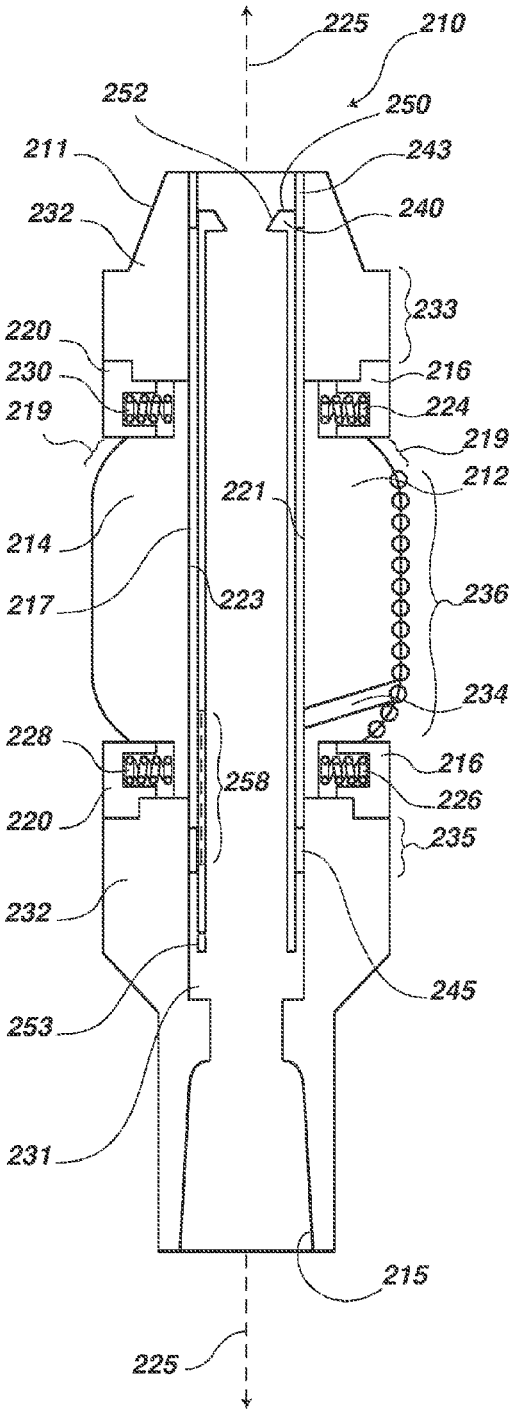
FIG. 2A is a conceptual side cross-sectional view of an expandable reamer of the present invention in a contracted state.
Figure 2B:
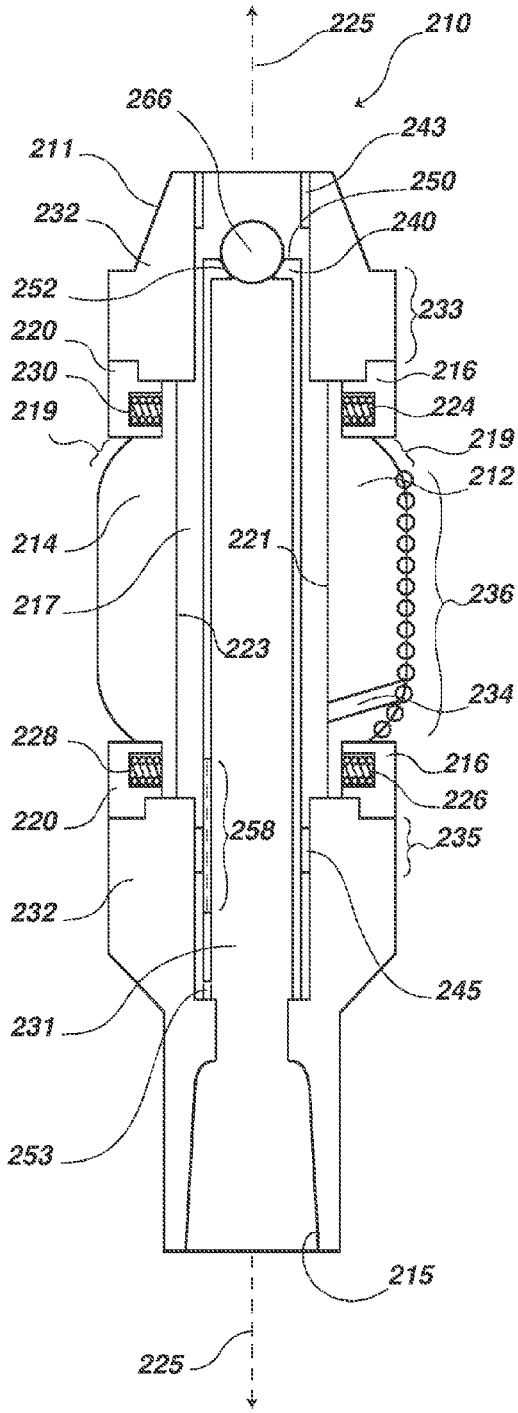
FIG. 2B is a conceptual side cross-sectional view of an expandable reamer of the present invention in an expanded state.

FIGS. 2A and 2B illustrate another exemplary embodiment of an expandable reamer 210 of the present invention, wherein a restriction element 266 may be used to actuate movable blades 212 and 214. Expandable reamer 210 includes a tubular body 232 with a bore 231 extending therethrough and movable blades 212 and 214 outwardly spaced from the centerline or longitudinal axis 225 of the tubular body 232, wherein each movable blade 212 and 214 may carry a plurality of cutting elements 236. Tubular body 232 may also include a male-threaded pin connection 211 as well as a female-threaded box connection 215. Cutting elements 236 are shown only on movable blade 212 for clarity, as the cutting elements on movable blade 214 may typically be facing in the direction of rotation of the expandable reamer 210 and, therefore, may not be visible in the view depicted in FIGS. 2A and 2B.

As depicted in FIG. 2A, the expandable reamer 210 is shown in a state where the movable blades 212 and 214 are positioned radially or laterally inwardly. Actuation sleeve 240 may be positioned longitudinally in a first position near the upper longitudinal end of the tubular body 232, so that the radial periphery of upper end 250 of the actuation sleeve 240 is positioned to seal against an actuation seal 243. Thus, drilling fluid (not shown) may pass through actuation sleeve 240, passing longitudinally by movable blades 212 and 214. Actuation seal 243 and lower sleeve seal 245 may prevent drilling fluid from interacting with movable blades 212 and 214, so long as the actuation sleeve 240 is appropriately positioned. The actuation sleeve 240 may be releasably restrained by way of shear pins, interlocking members, frictional elements, or frangible members, or otherwise may be configured to maintain its longitudinal position under a wide range of operating conditions.

However, a restriction element 266 may be deployed within the drilling fluid stream and may ultimately be disposed within sleeve seat 252, as shown in FIG. 2B. Initially, as restriction element 266 becomes disposed within sleeve seat 252, the actuation sleeve 240 longitudinal position may be as shown in FIG. 2A. However, drilling fluid pressure may cause the actuation sleeve 240 to be displaced longitudinally to a position shown in FIG. 2B. Upon contact between actuation seal 243 and the actuation sleeve 240 ceasing, drilling fluid may pass into an annulus 217 formed between inner surfaces 221 and 223 of movable blades 212 and 214, respectively, and the actuation sleeve 240. Although blade-biasing elements 224, 226, 228, and 230 may be configured to provide an inward radial or lateral force upon movable blades 212 and 214, drilling fluid pressure acting upon the inner surfaces 221 and 223 may generate a force that exceeds the inward radial or lateral force and movable blades 212 and 214 may be disposed radially or laterally outward, thus matingly engaging retention elements 216 and 220, respectively. Retention elements 216 and 220 may be affixed to tubular body 232 by way of removable lock rods (not shown) disposed therethrough and within regions 233 and 235 as described hereinabove in relation to FIGS. 1A, 1B, and 1D1. Thus, the movable blades 212 and 214 of expandable reamer 210 may be caused to expand to an outermost position and the borehole may be enlarged by the combination of rotation and longitudinal displacement of the expandable reamer 210.

In addition, the longitudinal position of the actuation sleeve 240 after the restriction element 266 is deployed, as shown in FIG. 2B, may be maintained or affixed by any number of means, such as interlocking members, pins, frictional members, or as otherwise known in the art. Thus, the expandable reamer 210 may be configured as a "one-shot" tool, wherein once the movable blades 212 and 214 are allowed to expand, the actuation system may not be reset without removing the tool from the borehole. Alternatively, the restriction element 266 and actuation sleeve 240 may be configured to allow for wireline tools or other means to reset the position of the actuation sleeve 240 and thereby reset the operating state of the expandable reamer 210 while within the borehole.

In order to allow drilling fluid to pass through the expandable reamer 210, the actuation sleeve 240 may be configured with grooves 258 formed within but not through the thickness of the actuation sleeve 240 that do not extend below the lower sleeve seal 245 in the position as shown in FIG. 2A. However, as shown in FIG. 2B, the grooves 258 extend both longitudinally above and longitudinally below the lower sleeve seal 245, which allows drilling fluid moving into the annulus 217 to pass longitudinally downwardly and into grooves 258, past lower sleeve seal 245, through scallops or holes 253 formed in the lower longitudinal end of actuation sleeve 240, thereby passing into the bore 231 of the tubular body 232 of expandable reamer 210. As such, the drilling fluid may pass through the expandable reamer 210 ultimately to be delivered to another downhole tool, pilot drill bit, or other drilling implement. Alternatively, the actuation sleeve 240 may include burst discs or other frangible members that allow drilling fluid to communicate between the bore 231 of the tubular body 232 of expandable reamer 210 and annulus 217 when actuation sleeve 240 allows drilling fluid to act upon the inner surfaces 221 and 223 of movable blades 212 and 214, respectively.

At least one movable blade of the expandable reamer 210 may be configured with a port 234 to aid in cleaning the formation cuttings from the cutting elements 236 affixed to the movable blades 212 and/or 214 during reaming/drilling. Port 234 may be configured near the lower longitudinal cutting elements 236 on the movable blade 212 and may be oriented at about 15° from the horizontal toward the upper longitudinal end of the expandable reamer 210. Of course, the present invention contemplates that a port 234 may be oriented as desired. Port 234 may be located near to, or actually as a part of, movable blade 212, as shown. Other configurations for communicating fluid from the interior of the tubular body 232 to the cutting elements 236 on the movable blades 212 and 214 are contemplated, including a plurality of ports 234 on at least one movable blade.

Accordingly, after radial or lateral expansion of movable blades 212 and 214, movable blades 212 and 214 may be caused to contract when the drilling fluid pressure decreases sufficiently so that blade-biasing elements 224, 226, 228, and 230 may exert a radially or laterally inward force to bias movable blades 212 and 214 radially or laterally inward. As noted hereinabove, a taper 219 may facilitate movable blades 212 and 214 returning radially or laterally inwardly via contact between the taper 219 and any other surface or body.

Figure 3:
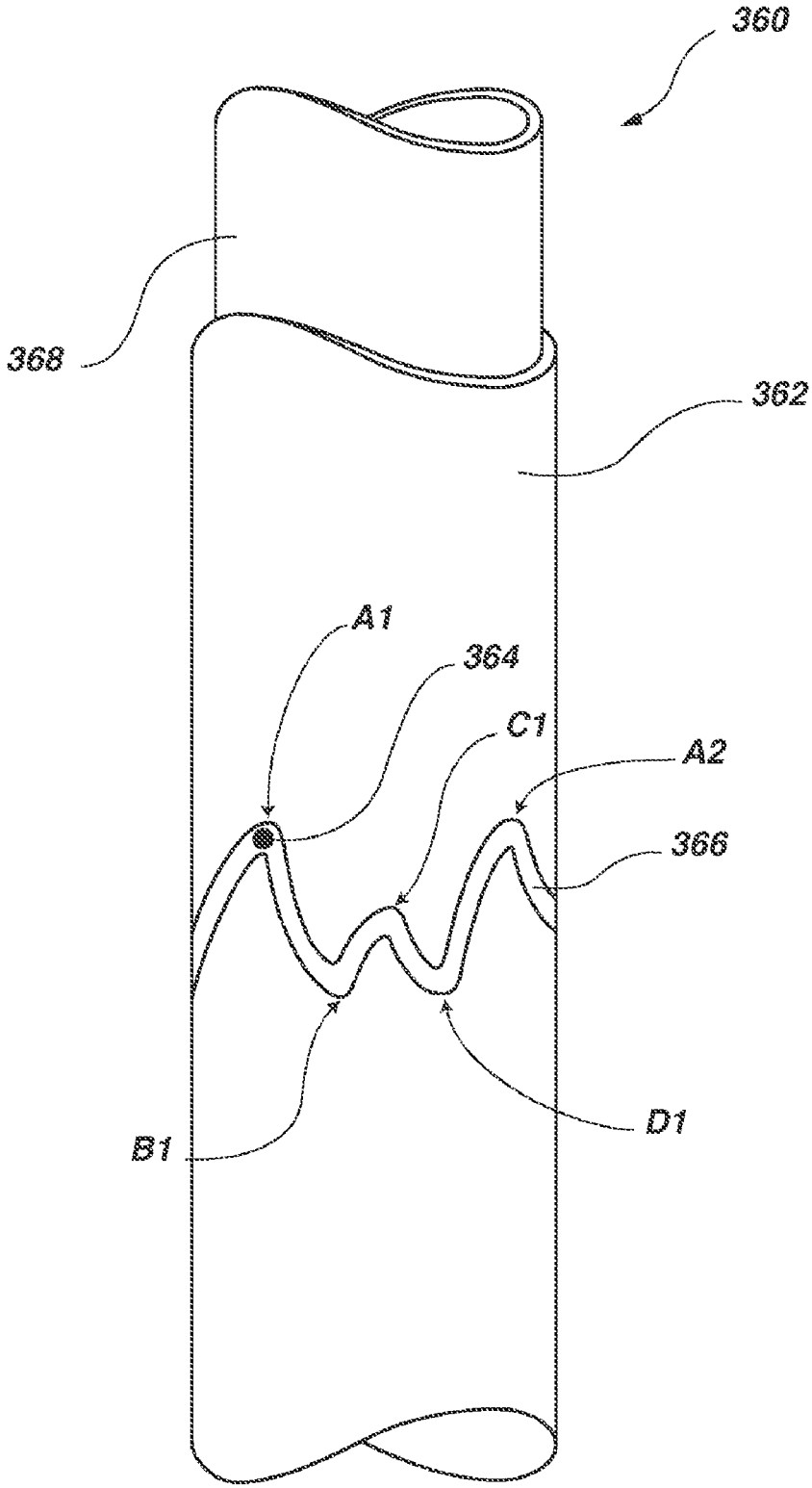
FIG. 3 is a conceptual perspective view of a pin guide sleeve of the present invention.

As a further aspect of the present invention, a pin guide sleeve assembly 360 as shown in FIG. 3 may be used to position an actuation sleeve 368 within an expandable reamer of the present invention. As illustrated in FIGS. 1A through 2B, an actuation sleeve may be used to cause movable blades of an expandable reamer to deploy. More specifically, the position of an actuation sleeve may cause the movable blades of the expandable reamer of the present invention to expand or contract. Thus, the position of an actuation sleeve 368 may be adjusted by way of a pin guide sleeve assembly 360 and thus may cause movable blades of an expandable reamer to deploy or retract.

FIG. 3 shows a pin guide sleeve assembly 360 wherein a groove 366 is formed within sleeve 362. Pin 364 may be disposed within the groove 366 and pin 364 may be affixed to an actuation sleeve 368 of an expandable reamer of the present invention. Thus, as the pin 364 may be caused to move within the groove 366, actuation sleeve 368 may be caused to move within an expandable reamer. Groove 366 may comprise a pattern of peaks and valleys, as represented by the regions A1, B1, C1, D1, and A2. Further, groove 366 may be configured to extend about the entire circumference of the sleeve 362 in a repeating, continuous manner, so that the pin 364 may be caused to repeatedly traverse within the groove 366 and about the circumference of the sleeve 362. For instance, groove 366 may comprise a series of alternating upwardly sloping and downwardly sloping arcuate paths. To facilitate movement of the pin 364 within the groove 366, it may be advantageous to configure the actuation sleeve 368 so that relatively high flow rates of drilling fluid cause the actuation sleeve 368 and pin 364 to be forced downward. Further, the actuation sleeve 368 may be configured with a restoring upward force by way of a biasing element as described hereinabove.

Therefore, considering the beginning at position A1 as shown in FIG. 3, the pin 364 may be traversed within the groove 366 to position B1 by way of a relatively high flow rate of drilling fluid, for instance, 800 gallons per minute. Sufficient reduction of the flow rate of drilling fluid may cause the restoring force of a biasing element to cause the pin 364 and actuation sleeve 368 to move upward, into position C1. Similarly, the pin 364 and actuation sleeve 368 may be caused to move to position D1 via a relatively high flow rate of drilling fluid. Further, sufficient reduction of the flow rate of drilling fluid may cause the pin 364 and actuation sleeve 368 to move to position A2. Of course, as mentioned above, the pattern may continue around the entire circumference of the sleeve 362, and may be continuous so that the sequence may be repeated any number of times. For instance, the groove 366 as shown in FIG. 3 may include peaks and valleys B2, C2, D2, A3, B3, C3, and D3 (not shown) on the portion of the circumference of the sleeve 362 not visible in FIG. 3. Further, the interaction between the flow rate and the restoring force may be configured so that drilling fluid flow rates used during typical operation, for instance, 400 gallons per minute flow rate of drilling fluid, may cause the pin 364 to traverse only a portion of the distance between either A1 and B1 or C1 and D1 (or generally any upper and lower points within the groove 366). This may be advantageous so that the operating condition of the expandable reamer may not change unexpectedly. Although the above description describes different longitudinal positions of the actuation sleeve 368, the present invention contemplates that rotation of pin 364 within pin guide sleeve assembly 360 may also cause actuation of movable blades within an expandable reamer of the present invention, without limitation.

Figure 4A:
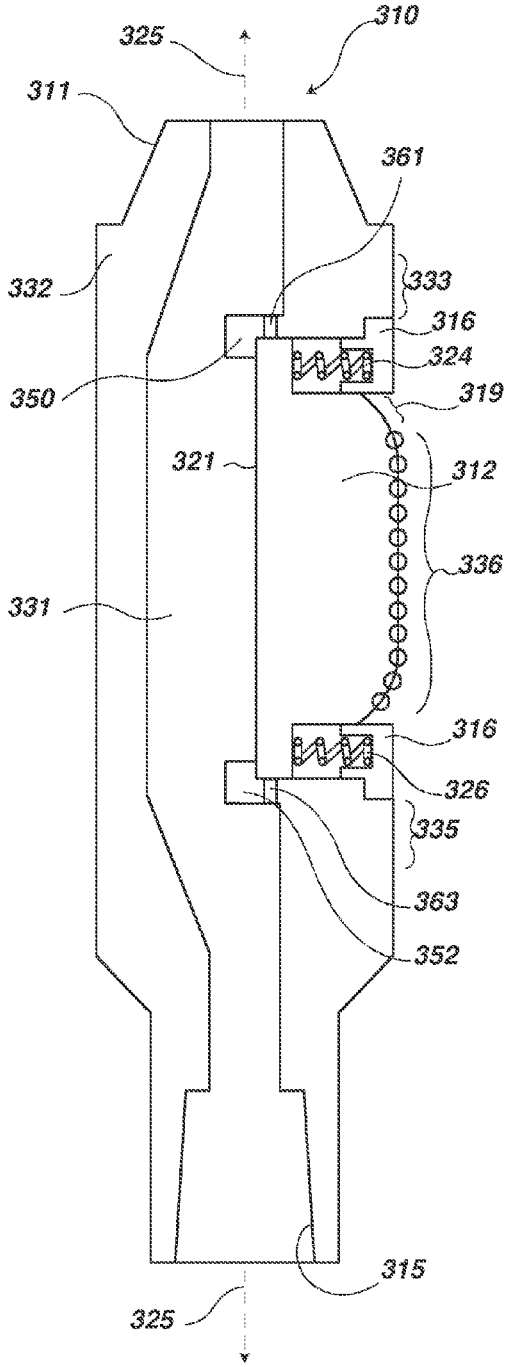
FIG. 4A is a conceptual side cross-sectional view of an expandable reamer of the present invention in a contracted state.
Figure 4B:
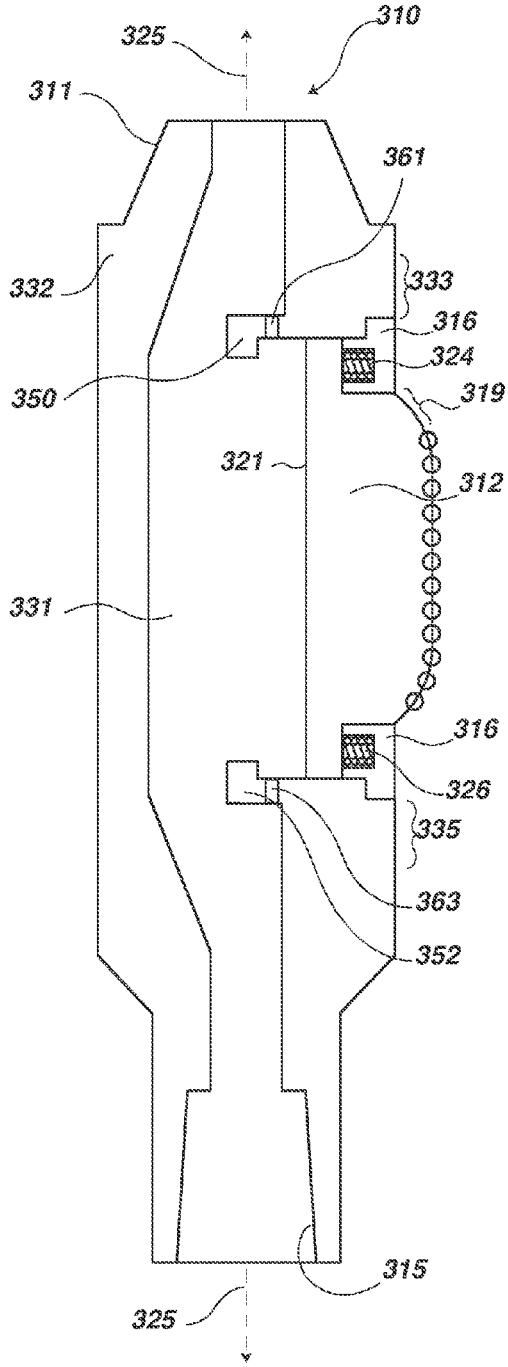
FIG. 4B is a conceptual side cross-sectional view of an expandable reamer of the present invention in an expanded state.

In a further embodiment of the present invention, an expandable reamer sub 310 with a movable blade 312 having an expanded outermost diameter that may exceed the diameter that is ordinarily attainable via conventional expandable reamers is shown in FIGS. 4A and 4B. More particularly, conventional reamers may only expand up to about 20% of their initial diameter. However, the expandable reamer of the present invention may expand up to about 40% of its initial diameter. Thus, the expandable reamer of the present invention may expand in excess of 20% of its initial diameter and up to about 40% of its initial diameter. For example, the expandable reamer sub of the present invention may include a blade that expands from an initial diameter of about 10.5 inches to an expanded diameter of about 14.75 inches. Conventional expandable reamers may be limited in expanding from an initial diameter of about 10.5 inches to an expanded diameter of about 14.75 inches. However, the present invention is not limited in its application to any particular size and may be applied to numerous sizes and configurations.

Expandable reamer sub 310 includes tubular body 332, bore 331, and movable blade 312 carrying cutting elements 336. In such a configuration, inner surface 321 of movable blade 312 may extend into the space near and past a longitudinal axis 325 (center) of the expandable reamer sub 310. Due to space limitations, where multiple movable blades are disposed with overlapping longitudinal extents, the radially inner surfaces may only extend to the longitudinal axis 325 of the expandable reamer sub 310. Retaining structures 350 and 352 may be disposed near the center of the expandable reamer sub 310, as shown in FIGS. 4A and 4B. Retaining structure 350, as shown in FIGS. 4A and 4B, includes a hole 361 for disposing a shear pin (not shown) and retaining structure 352 includes a hole 363 for disposing a shear pin (not shown). Further, the bore 331 extending through the expandable reamer sub 310 may be shaped to allow drilling fluid to pass around the movable blade 312 while contracted within the expandable reamer sub 310.

However, since it may be preferred to drill with multiple reaming/drilling blades, multiple expandable reamer subs 310 may be assembled together or to other drilling equipment via female-threaded box connection 315 and male-threaded pin connection 311. Accordingly, each movable blade 312 of each expandable reamer sub 310 may be aligned circumferentially as desired in relation to one another. For instance, three expandable reamer subs 310 may be assembled so that each movable blade 312 is circumferentially separated from another movable blade 312 by about 120°. Of course, many different assemblies containing different numbers of movable blades in different arrangements are contemplated by the present invention.

During operation, movable blade 312 may be pinned into place by way of shear pins (not shown) disposed within holes 361 and 363 extending into respective holes within movable blade 312, as known in the art. Further, bias forces applied by way of blade-biasing elements 324 and 326 may provide forces to retain the movable blade 312 against the retaining structures 350 and 352. However, as drilling fluid pressure may be increased, the forces generated thereby may cause shear pins (not shown) within holes 361 and 363 and extending into movable blade 312 to fail. In turn, the pressure of the drilling fluid on the inner surface 321 of the movable blade 312 may cause the movable blade 312 to be disposed radially or laterally outwardly, matingly engaging retention element 316 as shown in FIG. 4B. Retention element 316 may be affixed to tubular body 332 of expandable reamer sub 310 by way of removable lock rods (not shown) disposed within holes (not shown) in regions 333 and 335 as described hereinabove. Of course, as drilling fluid pressure may be decreased, the movable blade 312 may be biased by the blade-biasing elements 324 and 326 toward the position shown in FIG. 4A. In addition, taper 319 may encourage the movable blade 312 to return radially or laterally inward.

Figure 5A:
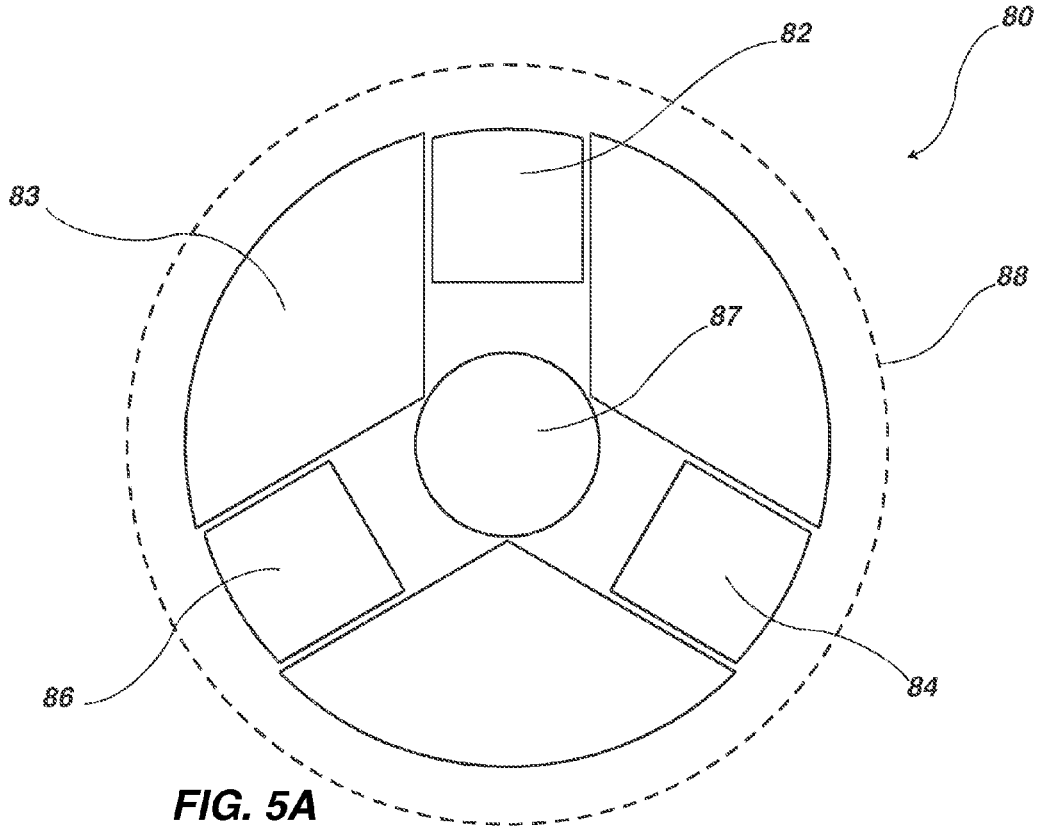
FIG. 5A is a schematic bottom view of a symmetric movable blade arrangement of an expandable reamer of the present invention in an expanded state.
Figure 5B:
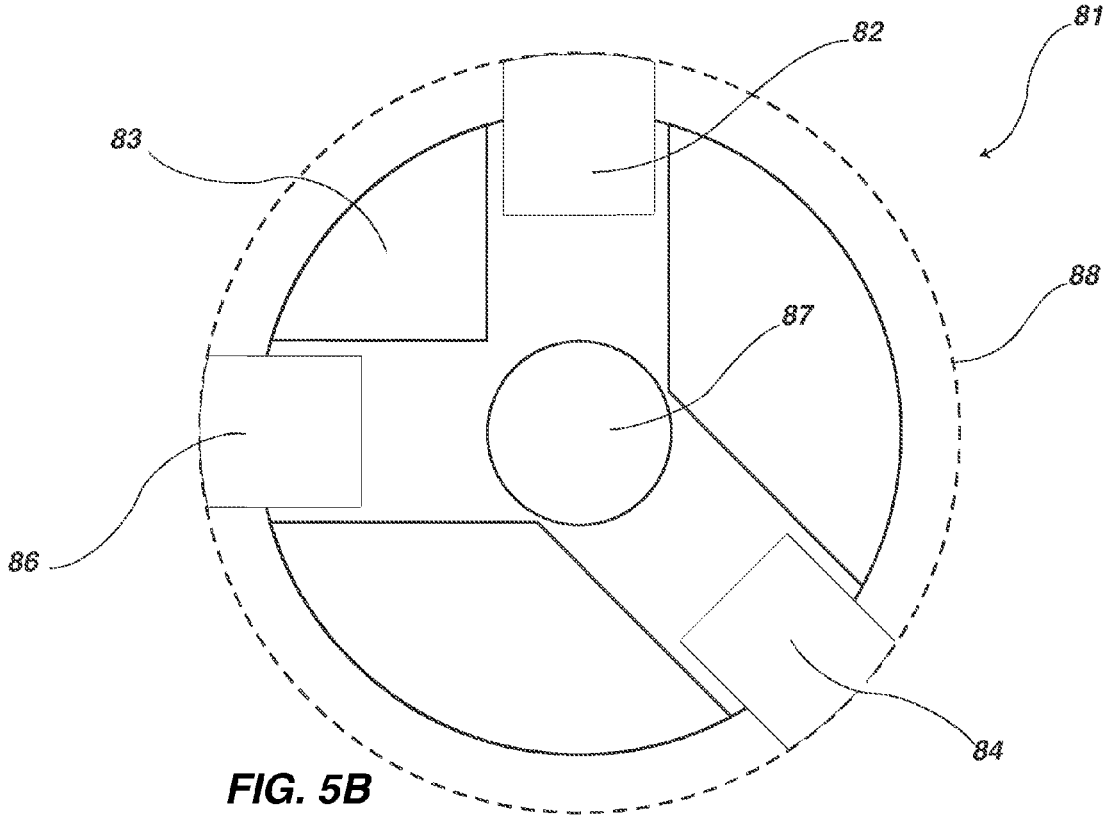
FIG. 5B is a schematic bottom view of an asymmetric movable blade arrangement of an expandable reamer of the present invention in an expanded state.

Turning to FIG. 5A, a bottom cross-sectional view of an expandable reamer 80 of the present invention is shown schematically wherein the movable blades 82, 84, and 86 are arranged circumferentially symmetrically within tubular body 83 about bore 87 of the expandable reamer 80. Put another way, adjacent movable blades 82, 84, and 86 are separated by about 120° from one another. Movable blades 82, 84, and 86 are shown in their innermost radial or lateral positions, respectively; however, reference diameter 88 illustrates the borehole diameter that would be drilled if movable blades 82, 84, and 86 were disposed at their outermost radial or lateral positions, respectively. In comparison, FIG. 5B shows a schematic bottom cross-sectional view of an expandable reamer 81 of the present invention wherein movable blades 82, 84, and 86 are configured in a circumferentially asymmetrical arrangement within tubular body 83 about bore 87 of an expandable reamer 81. Also, movable blades 82, 84, and 86 are positioned at their outermost radial or lateral position, thus substantially conforming to reference diameter 88. Of course, many different movable blade positions and configuration embodiments are possible and are contemplated by the present invention. For instance, movable blades 82, 84, and 86 may be positioned along a general helix or spiral with respect to the longitudinal axis of the reaming assembly. Further, the movable blade shapes may be tapered, angled, or otherwise configured. In addition, movable blades 82, 84, and 86 may be displaced along helical, lateral, or spiral paths, or other various displacement paths to effect overall radial or lateral displacement.

Figure 5C:
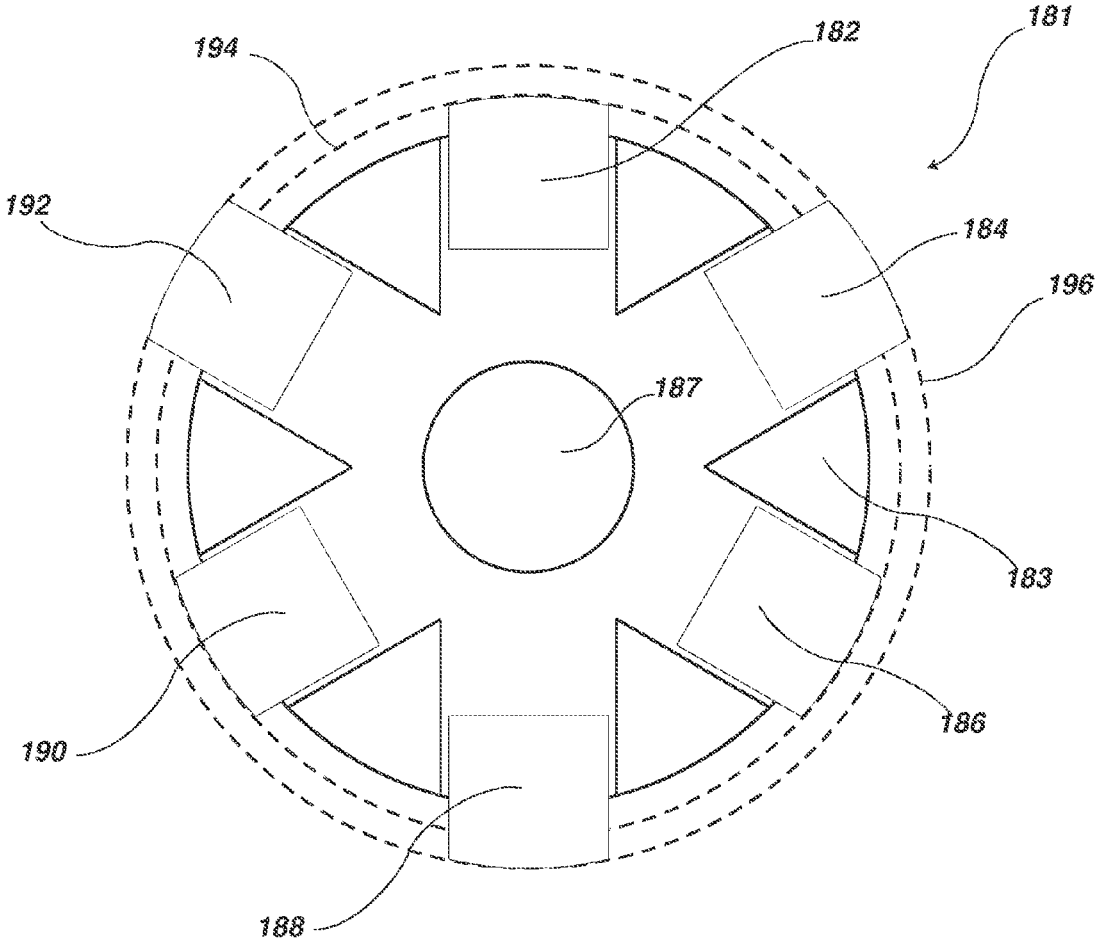
FIG. 5C is a schematic bottom view of an expandable reamer of the present invention including a first set of movable blades configured to expand to a first outer diameter and a second set of movable blades configured to expand to a second diameter in an expanded state.

Furthermore, different movable blades may be configured to drill at different diameters. FIG. 5C schematically shows a cross-sectional bottom view of an expandable reamer 181 of the present invention where movable blades 182, 186, and 190 are configured in a circumferentially symmetric arrangement about bore 187 and are shown at their outermost radial or lateral positions, substantially conforming to reference diameter 194. In addition, movable blades 184, 188, and 192 are configured in a circumferentially symmetric arrangement about bore 187 and are shown at their outermost radial or lateral positions, thus substantially conforming to reference diameter 196. Prior to expansion, movable blades 182, 184, 186, 188, 190, and 192 may be positioned at substantially the outer diameter of tubular body 183. Further, movable blades 182, 186, and 190 may be configured to actuate or be displaced radially or laterally outwardly under operating conditions different from movable blades 184, 188, and 192. Conversely, movable blades 182, 186, and 190 may be configured to actuate or be displaced outwardly under substantially the same operating conditions as movable blades 184, 188, and 192. Accordingly, as may be seen from FIG. 5C, the expandable reamer of the present invention contemplates different sets of movable blades corresponding to different effective drilling diameters.

Figure 6A:
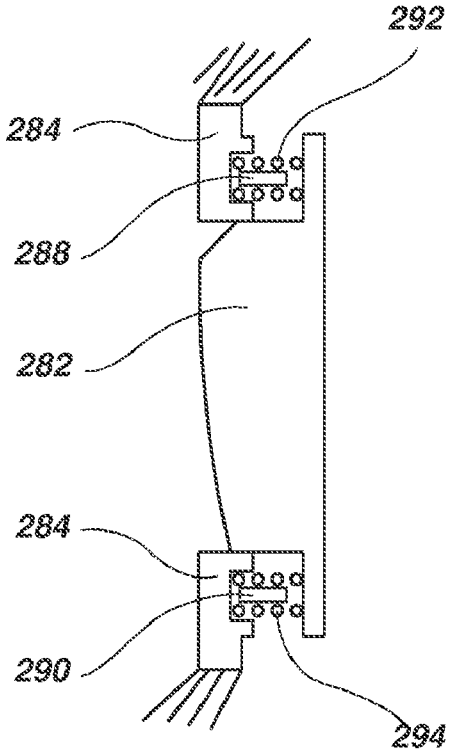
FIGS. 6A and 6B illustrate side cross-sectional views of adjustable spacing elements in relation to movable blades of the present invention.
Figure 6B:
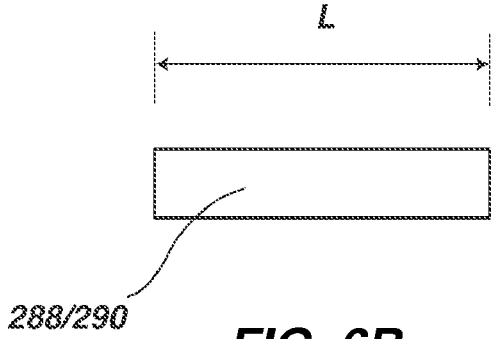

In any of the above embodiments of expandable reamers of the present invention, adjustable spacer elements may be employed so that an expandable reamer may be adjustable in its reaming diameter. Such a configuration may be advantageous to reduce inventory and machining costs, and for flexibility in use of the expandable reamer. FIGS. 6A and 6B show adjustable spacer elements 288 and 290 that may be replaced and/or adjusted. More specifically, for example, length "L" as shown in FIG. 6B may be modified so that the outermost radial or lateral position of movable blade 282 may be adjusted accordingly. Adjustable spacer elements 288 and 290 may be disposed within blade-biasing elements 292 and 294 as shown in FIG. 6A, or may be affixed to movable blade 282 or retention element 284. Thus, utilizing adjustable spacer elements 288 and 290 may allow for a single movable blade design and spacing element design to be used in various borehole sizes and applications. For instance, the expandable reamer of the present invention, including adjustable spacer elements 288 and 290, may enlarge a particular section of borehole to a first diameter, then may be removed from the borehole and another set of adjustable spacer elements having a different length "L" may replace adjustable spacer elements 288 and 290, then the expandable reamer may be used to enlarge another section of borehole at a second diameter. Further, minor adjustment of the outermost lateral position of the movable blade may be desirable during drilling operations by way of threads or other adjustment mechanisms when adjustable spacer elements 288 and 290 are affixed to either the movable blade 282 or retention element 284.

Figure 7A:
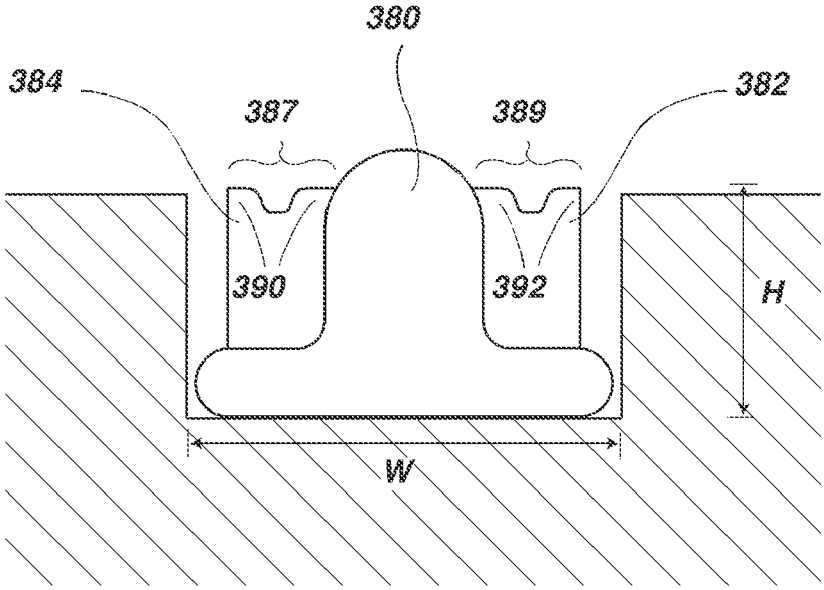
FIGS. 7A and 7B illustrate side cross-sectional views of a seal arrangement of the present invention.
Figure 7B:
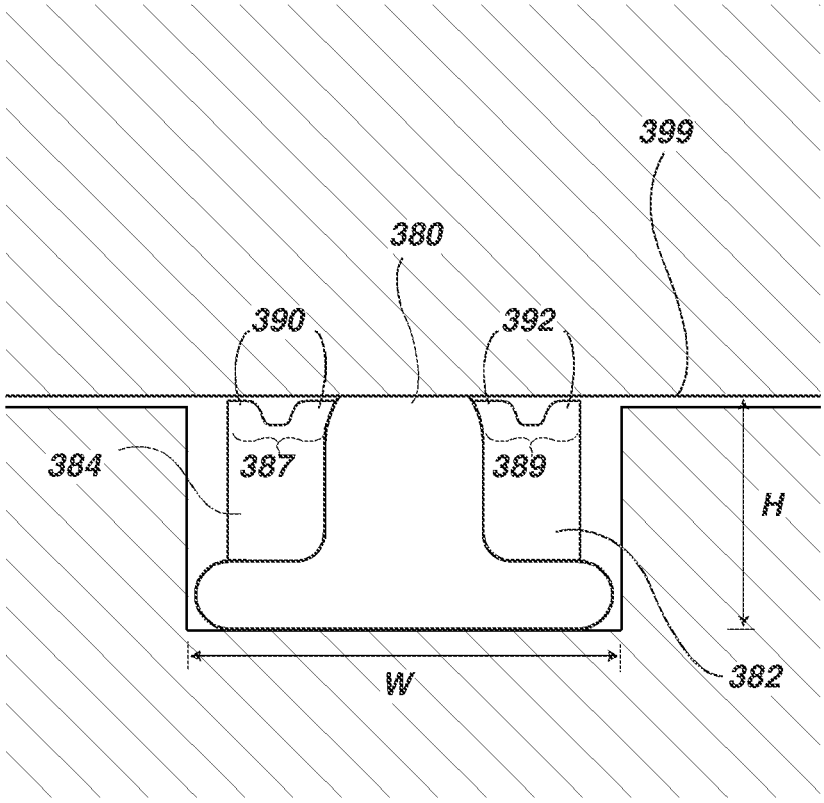

Also applicable generally to the embodiments of the present invention including movable blades is a particular seal arrangement, as shown in FIGS. 7A and 7B. A T-shaped seal 380 comprising a relatively soft material, such as VITON™, may be disposed adjacent to one or more relatively stiff backup seals 384 or 382 having a wiping surface 387 or 389 including at least two ridges 390 or 392, respectively. More specifically, the width W of the T-shaped seal 380 may be about 0.585 inch, while the height H of the backup seals 382 and 384 may be about 0.245 inch. Because backup seals 384 and 382 are relatively stiff, they must each have one cut or slice therethrough to allow the backup seal 384 or 382 to collapse to a reduced diameter for insertion and subsequently enable the backup seal 382 or 384 to open to its larger, normal diameter and fit into the groove with T-shaped seal 380. When a backup seal 382 or 384 is in place, it returns to its normal diameter adjacent T-shaped seal 380. Such a configuration may be advantageous for inhibiting interaction between the T-shaped seal 380 and contaminants. More specifically, as shown in FIG. 7B, upon compression of and subsequent applied differential pressure to T-shaped seal 380 by way of adjacent surface 399, the backup seals 384 and 382 may contact the adjacent surface 399. Thus, as either the T-shaped seal 380 or surface 399 moves relative to one another, one of the backup seals 384 or 382 contacts the surface 399 prior to the T-shaped seal 380, according to the direction of travel. Ridges 390 and 392 may therefore facilitate removal of contaminants from the surface 399 and thereby inhibit contaminants from contacting T-shaped seal 380. Ridges 390 and 392 are one possible configuration for backup seals 384 or 382; however, any nonplanar surface geometry may be used as well. Of course, relative motion between the T-shaped seal 380 and another surface may be anticipated in one direction only. Therefore, one backup seal configured with ridges and located adjacent the T-shaped seal 380 preceding the anticipated direction of movement may be sufficient to protect the T-shaped seal 380.

Moreover, compensator systems may be employed in combination with any dynamic seals of the present invention. As an example, a compensator system such as the compensator system for roller cone rotary drill bits disclosed in U.S. Pat. No. 4,727,942, assigned to the assignee of the present invention and incorporated herein in its entirety by reference, may be included within the expandable reamer of the present invention.

Figure 8A:
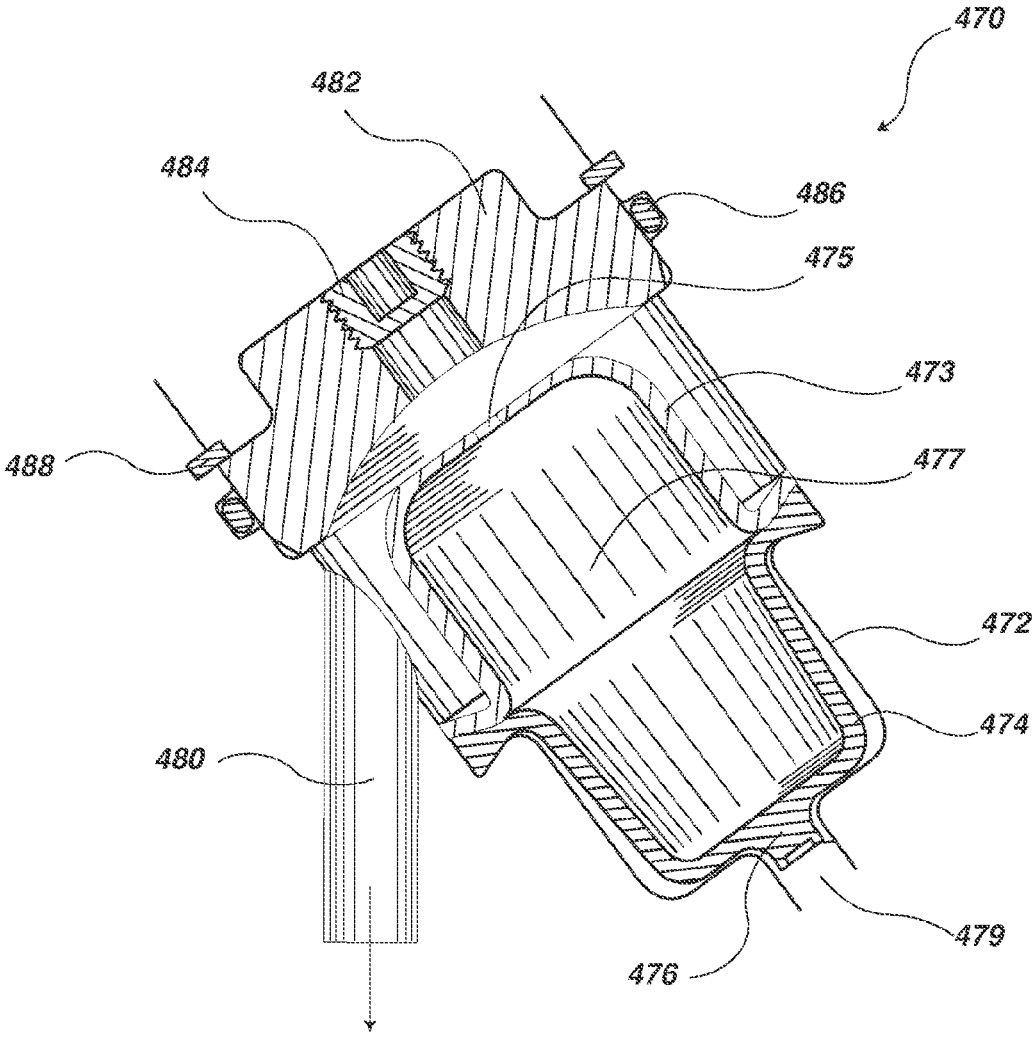
FIG. 8A shows a side cross-sectional view of a conventional compensator.
Figure 8B:
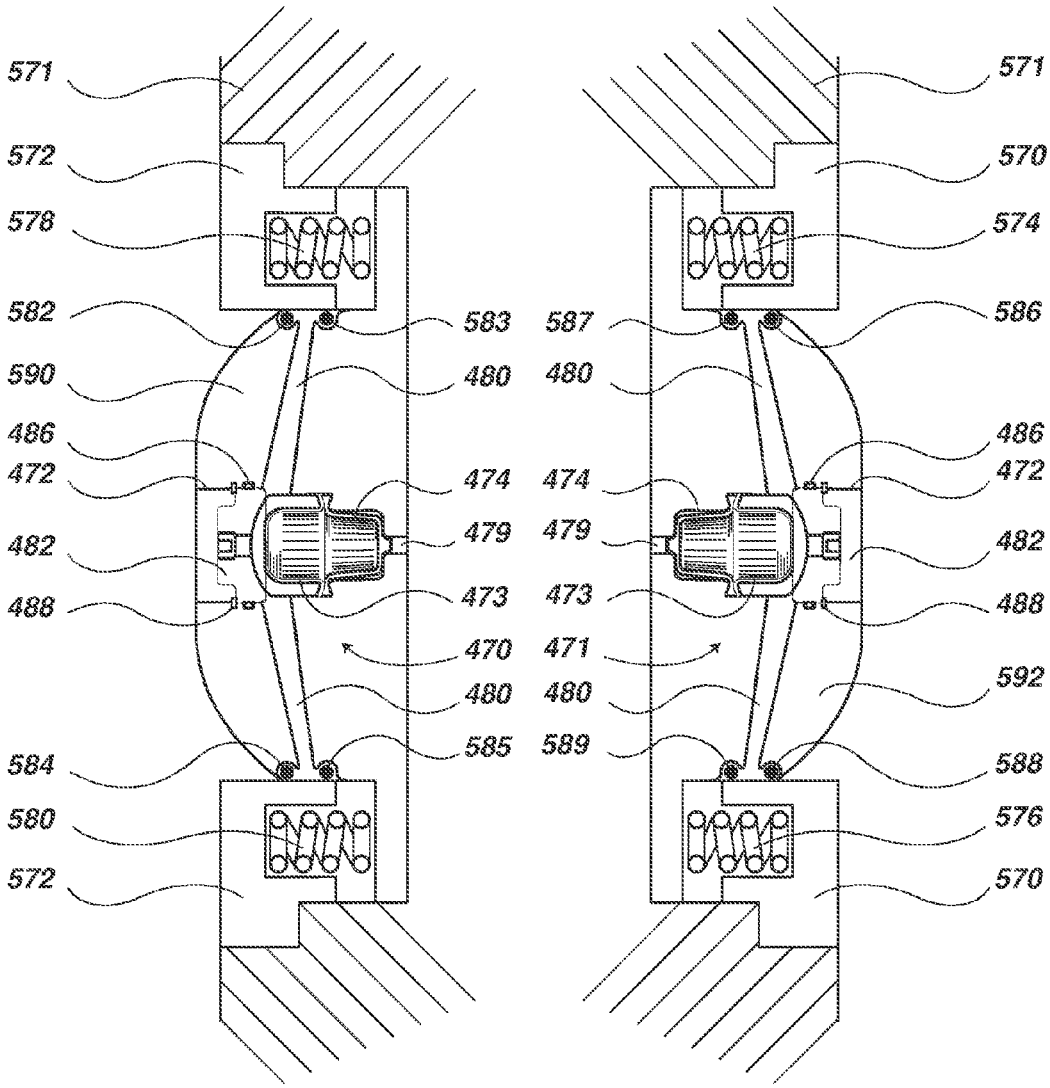
FIG. 8B shows a side cross-sectional view of the compensator as shown in FIG. 8A disposed within movable blades of the present invention.

As shown in FIGS. 8A and 8B, shaped cavity 472 may be formed wherein the end 479 thereof may allow communication with drilling fluid. A flexible diaphragm 474 and protector cup 473 may be disposed therein, as shown in FIG. 8A. The chamber formed between the flexible diaphragm 474 and the protector cup 473 may be filled with lubricant 477. A compensator cap 482, snap ring 488, lubricant plug 484, and sealing element 486 may allow for assembly of compensator 470, as well as replacement of the lubricant 477, protector cup 473, or flexible diaphragm 474.

Compensator 470 may substantially equalize drilling fluid pressure with lubricant pressure and may cause lubricant 477 to be supplied to a seal (not shown). Flexible diaphragm 474 having a small perforation 476 therein may be exposed on one side to the pressure of the drilling fluid and on the other side to lubricant 477 supplied to a bearing or seal (not shown). If the pressure of the lubricant 477 exceeds the pressure of the drilling fluid, a portion of lubricant 477 may be released through the small perforation 476 into the drilling fluid, thereby substantially equalizing the pressure of the lubricant 477 to the drilling fluid pressure. If the pressure of the drilling fluid exceeds the pressure of the lubricant 477, the small perforation 476 may be effectively sealed thereby, and the flexible diaphragm 474 may deform to push a portion of lubricant 477 through aperture 475 and into lubricant delivery tube 480. Lubricant delivery tube 480 may typically communicate with a seal (not shown), thereby supplying lubricant 477 thereto.

As shown in FIG. 8B, compensators 470, 471 may be disposed within movable blades 590 and 592, affixed to tubular body 571 by way of retention elements 572 and 570, respectively. Movable blade 590 includes seal elements 582 and 584 disposed in grooves 583 and 585 extending about an exterior thereof, while movable blade 592 includes seal elements 586 and 588 disposed in grooves 587 and 589 extending about an exterior thereof. Compensator 470 acts upon the lubricant in communication with a circumferential area on the exterior of movable blade 590 located between seal elements 582 and 584 while compensator 471 acts upon the lubricant in communication with a circumferential area on the exterior of movable blade 592 located between seal elements 586 and 588. More specifically, compensator 470 may supply lubricant to seal elements 582 and 584 via lubricant delivery tubes 480. Similarly, compensator 471 may supply lubricant to seal elements 586 and 588 via lubricant delivery tubes 480. Accordingly, as movable blades 590 and 592 move radially or laterally inwardly and outwardly, compensators 470, 471 move therewith, respectively. It may be advantageous to configure seal elements 582, 584, 586 and 588 so that radially inward seal elements 584 and 588 may preferentially prevent lubricant from passing thereby in relation to radially outward seal elements 582 and 586, respectively. For instance, radially inward seal elements 584 and 588 may be held in greater compression than radially outward seal elements 582 and 586. Such a configuration may prevent lubricant from contacting blade-biasing elements 574, 576, 578, and 580, and may further prevent debris from entering across radially outward seal elements 582 and 586. Of course, a compensator may be disposed, sized, and oriented within the tubular body of an expandable reamer of the present invention as physical size allows. For instance, it may be preferred to orient the end 479 of the shaped cavity 472 to communicate with the exterior of the movable blades 590 and 592. Furthermore, a compensator may be employed with respect to lubricant in communication with roller or thrust bearings, bushings, static seals, actuation sleeve seals, or any other moving elements within the expandable reamer of the present invention, without limitation.

Figure 9A:
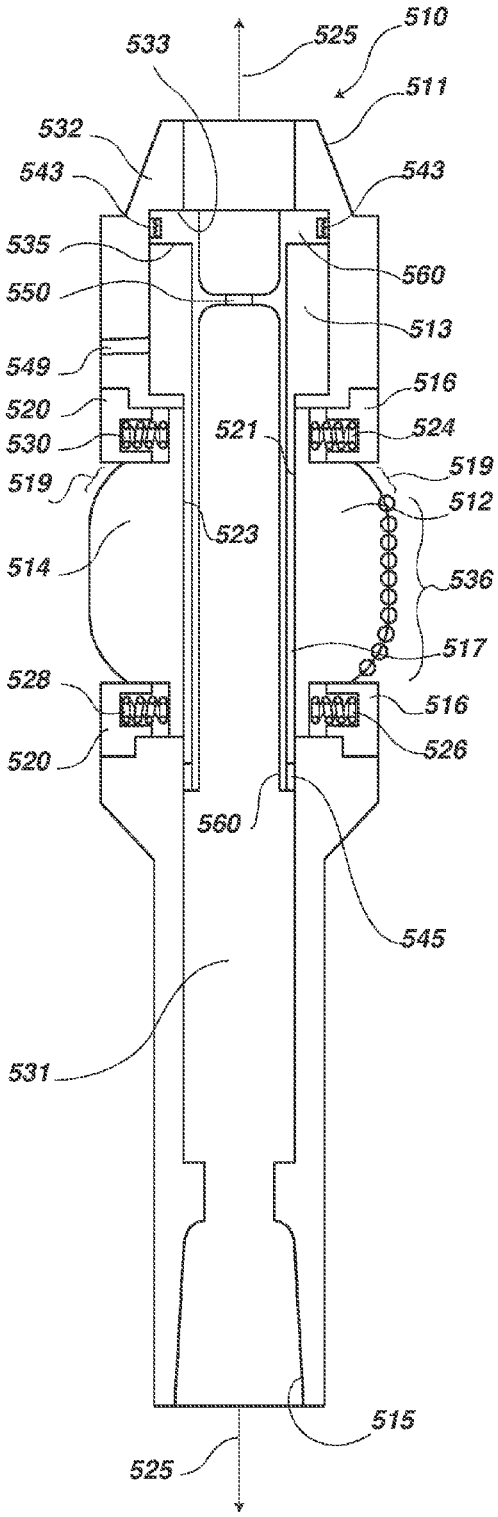
FIGS. 9A and 9B depict side cross-sectional views of an expandable reamer of the present invention, including a separation element for expanding movable blades thereof, in a contracted state and expanded state, respectively.
Figure 9B:
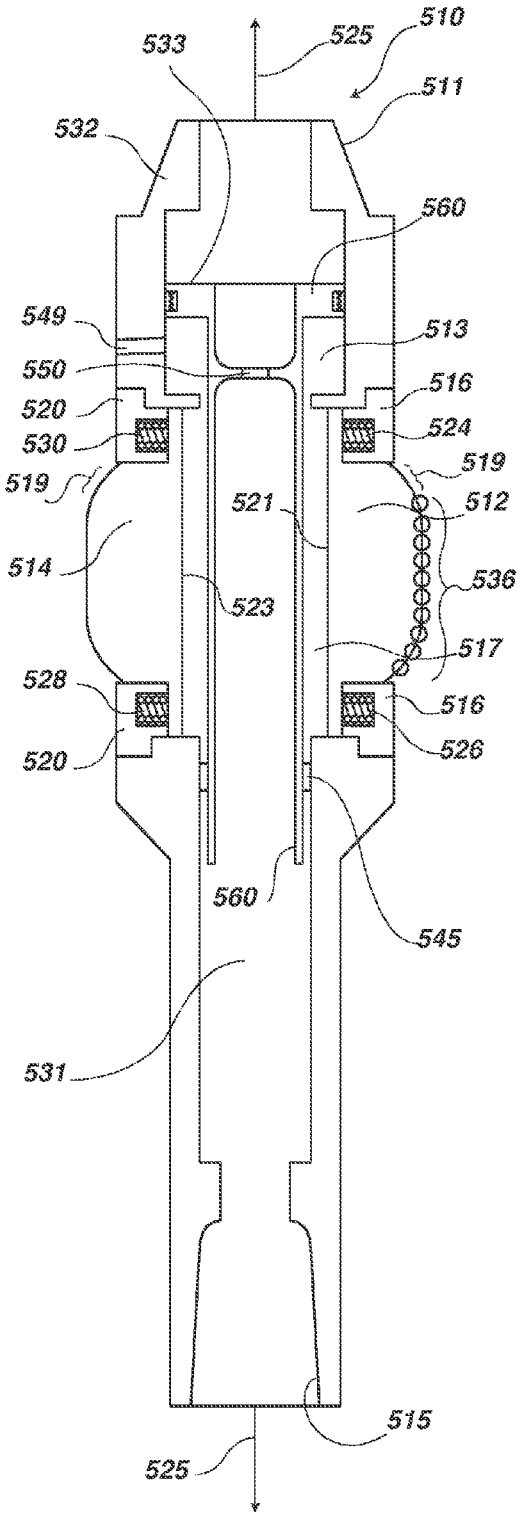

In another exemplary embodiment of the present invention, a separation element actuation system may actuate as well as maintain the cleanliness and functionality of movable blades 512 and 514 of expandable reamer 510 of the present invention. FIGS. 9A and 9B illustrate the expandable reamer 510 of the present invention including movable blades 512 and 514 outwardly spaced from centerline or longitudinal axis 525 of tubular body 532, affixed therein by way of retention elements 516 and 520, respectively, and carrying cutting elements 536 (only shown on movable blade 512 for clarity). Tubular body 532 includes a bore 531 therethrough for conducting drilling fluid, as well as a male-threaded pin connection 511 and a female-threaded box connection 515. As shown in FIGS. 9A and 9B, a separation element 560, including a reduced cross-sectional orifice 550, may also comprise sealing element 543. Thus, drilling fluid may act upon upper surface 533 of one side of the separation element 560, while another fluid, such as oil, acts upon lower surface 535 of the separation element 560. Such a configuration may substantially inhibit drilling fluid from contacting inner surfaces 521 and 523 of movable blades 512 and 514. Accordingly, as may be seen in FIGS. 9A and 9B, an upper chamber 513 and an annulus 517 formed between the separation element 560 and the inner surfaces 521 and 523 of the movable blades 512 and 514 may be sealed from drilling fluid passing through expandable reamer 510 by sealing element 543, as well as lower sealing element 545. Upper chamber 513 and annulus 517 may be filled with a fluid by way of port 549, which may be sealed otherwise by way of a threaded plug or as otherwise configured during use of the expandable reamer 510.

Thus, during operation, separation element 560 may be positioned longitudinally in a first position, as shown in FIG. 9A. Drilling fluid may pass through separation element 560, thus passing by movable blades 512 and 514, and exiting the separation element 560 at its lower longitudinal end. A shear pin (not shown) or other frangible element (not shown) may restrain separation element 560 in its initial longitudinal position, as shown in FIG. 9A. As drilling fluid passes through separation element 560, the reduced cross-sectional orifice 550 may produce a force upon the separation element 560 and may cause a friable or frictional element (not shown) to release the separation element 560 and allow the separation element 560 to move longitudinally downward.

As the longitudinal position of the separation element 560 changes, fluid within the upper chamber 513 may be transferred into the annulus 517 and pressure may develop therein. Thus, pressure developed within annulus 517 acts on the inner surfaces 521 and 523 of movable blades 512 and 514, respectively, against forces generated by way of blade-biasing elements 524, 526, 528, and 530. Sufficient pressure acting upon the inner surfaces 521 and 523 may cause the movable blades 512 and 514 to move radially or laterally outwardly to an outermost radial or lateral position, matingly engaging retention elements 516 and 520, respectively, as shown in FIG. 9B. Also, upon sufficient reduction of drilling fluid flow and, accordingly, the pressure within annulus 517, the expandable reamer 510 may substantially return to its initial operational state, as shown in FIG. 9A. More specifically, blade-biasing elements 524, 526, 528, and 530, in conjunction with or independent of taper 519, may cause movable blades 512 and 514 to return radially or laterally inwardly, thus causing separation element 560 to return longitudinally upwardly.

Alternatively, instead of a separation element that transmits or communicates pressure or forces to another fluid in communication with movable blades, movable blades of the present invention may be separated from drilling fluid by way of a fixed barrier. For instance, in reference to FIG. 9A, the separation element 560 may be fixed within the tubular body 532 by way of bolts or pins, or as otherwise configured. Furthermore, pressurized fluid or gas may be supplied within annulus 517 by way of a downhole pump or turbine via port 549. Accordingly, the movable blades 512 and 514 may be deployed thereby. Such a configuration may allow for expandable reamer 510 to be expanded irrespective of drilling fluid flow rates or pressures. Of course, many configurations may exist where the movable blades may communicate with a nondrilling fluid pressurized by a downhole pump or turbine. For instance, in any embodiments including an actuation sleeve, the actuation sleeve may be fixed in a position separating drilling fluid from communication with any movable blades and a port may be provided to pressurize the movable blades.

Figure 10:
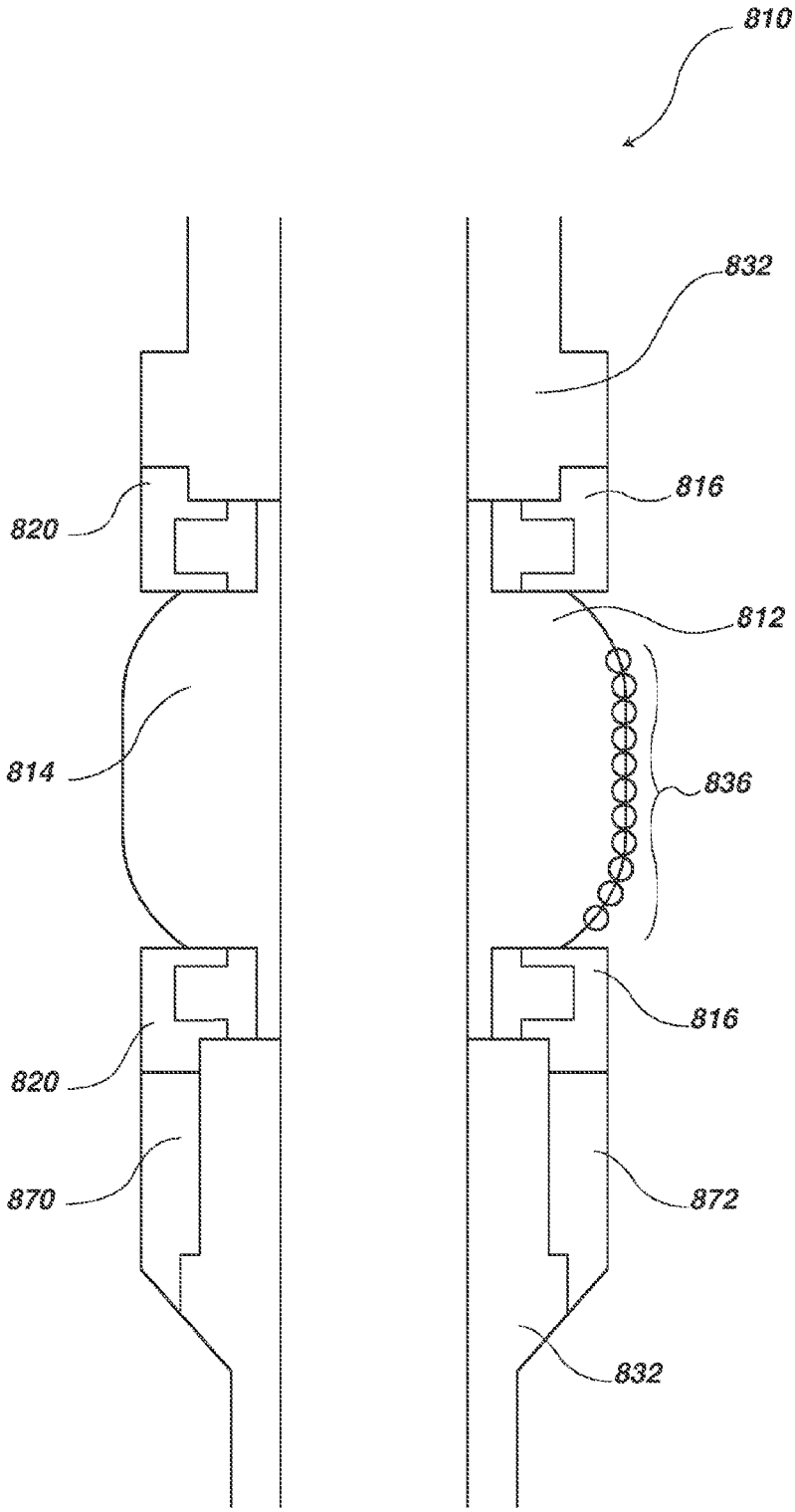
FIG. 10 is a side cross-sectional view of an expandable reamer of the present invention including replaceable bearing pads.

In a further aspect of the present invention, FIG. 10 shows a partial side cross-sectional view of an expandable reamer 810 including replaceable bearing pads 870 and 872. Expandable reamer 810 includes movable blades 812 and 814 affixed within tubular body 832 by way of retention elements 816 and 820, respectively, and carrying cutting elements 836 (only shown on movable blade 812 for clarity). Replaceable bearing pads 870 and 872 may be affixed to tubular body 832 by way of removable lock rods (not shown) as described hereinabove. Thus, replaceable bearing pads 870 and 872 may be removed from tubular body 832 by way of removing the removable lock rods (not shown). Alternatively, replaceable bearing pads 870 and 872 may be affixed to tubular body 832 by way of pins, threaded elements, splines, or dovetail configurations, or as otherwise known in the art. Replaceable bearing pads 870 and 872 may comprise hardfacing materials, diamond, tungsten carbide, tungsten carbide bricks, tungsten carbide matrix, or superabrasive materials. As shown in FIG. 10, replaceable bearing pads 870 and 872 may be disposed longitudinally preceding movable blades 812 and 814 in the direction of drilling or reaming. Accordingly, replaceable bearing pads 870 and 872 may be sized to substantially correspond to the outer diameter of the pilot drill bit (not shown) affixed to the lower longitudinal end of the expandable reamer 810. Such a configuration may be advantageous for stabilizing the expandable reamer 810 during use thereof.

Figure 11A:
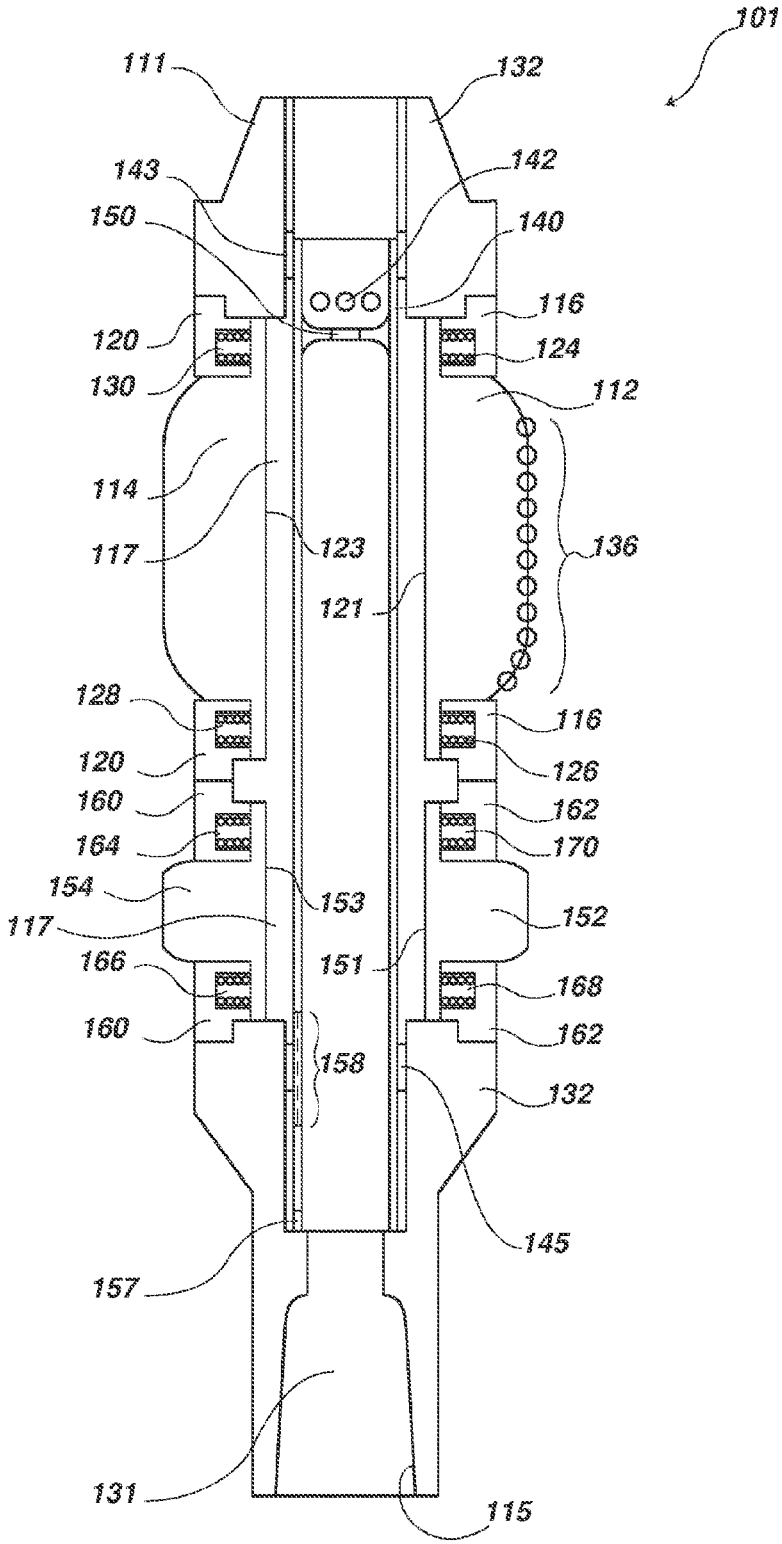
FIG. 11A is a side cross-sectional view of an expandable reamer of the present invention including expandable bearing pads.

Movable bearing pads may also be included within the expandable reamer of the present invention. FIG. 11A shows an expandable reamer 101 of the present invention including movable bearing pads 152 and 154, wherein both movable blades 112 and 114, as well as movable bearing pads 152 and 154, are disposed at their outermost lateral positions. Further, expandable reamer 101 includes tubular body 132, bore 131, and movable blades 112 and 114 carrying cutting elements 136 (shown only on movable blade 112, for clarity). Retention elements 116 and 120 may retain movable blades 112 and 114 within tubular body 132 by way of removable lock rods (not shown) or as otherwise configured. Similarly, bearing pad retention elements 160 and 162 may retain movable bearing pads 154 and 152, respectively, within tubular body 132. Tubular body 132 may include a male-threaded pin connection 111, female-threaded box connection 115, and bore 131 extending therethrough.

The position of actuation sleeve 140 may allow or prevent drilling fluid from acting upon inner surfaces 121 and 123 of movable blades 112 and 114, respectively, as well as inner surfaces 151 and 153 of movable bearing pads 152 and 154, respectively. More specifically, actuation sleeve 140 may include a reduced cross-sectional orifice 150 configured to develop force thereon by way of drilling fluid flowing therethrough. Thus, in an initial position (not shown) apertures 142 may be positioned above actuation seal 143, preventing drilling fluid from acting on either the movable blades 112 and 114 or movable bearing pads 152 and 154. In addition, seal 145 may prevent drilling fluid passing through the actuation sleeve 140 from communicating with annulus 117. However, upon sufficient force developed by way of drilling fluid passing through the reduced cross-sectional orifice 150, the actuation sleeve 140 may move to a longitudinal position as shown in FIG. 11A, thus allowing drilling fluid to act upon the inner surfaces 121 and 123 of movable blades 112 and 114, respectively, as well as the inner surfaces 151 and 153 of movable bearing pads 152 and 154, respectively. Drilling fluid may continue to pass through the expandable reamer 101 by way of grooves 158 formed within but not through the outer thickness of the actuation sleeve 140, effectively allowing drilling fluid to pass by seal 145 and through scallops or holes 157 into bore 131 of the tubular body 132.

Therefore, operation of expandable reamer 101 is generally similar to the operation described hereinabove with respect to FIGS. 1A and 1B, in that movable blades 112 and 114 may be forced against blade-biasing elements 124, 126, 128, and 130 configured to provide an inward radial or lateral force thereon, respectively, opposing forces developed by drilling fluid acting upon the inner surfaces 121 and 123 of movable blades 112 and 114. In addition, movable bearing pads 154 and 152 may expand or contract radially or laterally according to the drilling fluid pressure and the forces applied thereto by way of associated bearing-pad-biasing elements 164, 166, 168 and 170. More particularly, movable bearing pad 154 compresses biasing elements 164 and 166, while movable bearing pad 152 compresses biasing elements 168 and 170, according to the drilling fluid pressure acting upon inner surfaces 153 and 151. Upon sufficient drilling fluid pressure acting upon inner surfaces 151 and 153, movable bearing pad 154 matingly engages retention element 160 at its outermost radial or lateral position, while movable bearing pad 152 matingly engages retention element 162 at its outermost radial or lateral position, as shown in FIG. 11A. Movable bearing pads 154 and 152 may be configured, via bearing-pad-biasing elements 164, 166, 168 and 170 to expand under different conditions than the movable blades 112 and 114. For instance, movable bearing pads 152 and 154 may be configured to expand at less pressure than movable blades 112 and 114 to provide increased stability to the expandable reamer 101 prior to the movable blades' 112 and 114 movement to their outermost lateral positions. Of course, the expandable reamer 101 may comprise one or more movable bearing pads configured in circumferentially asymmetric or symmetric arrangements.

Figure 11B:
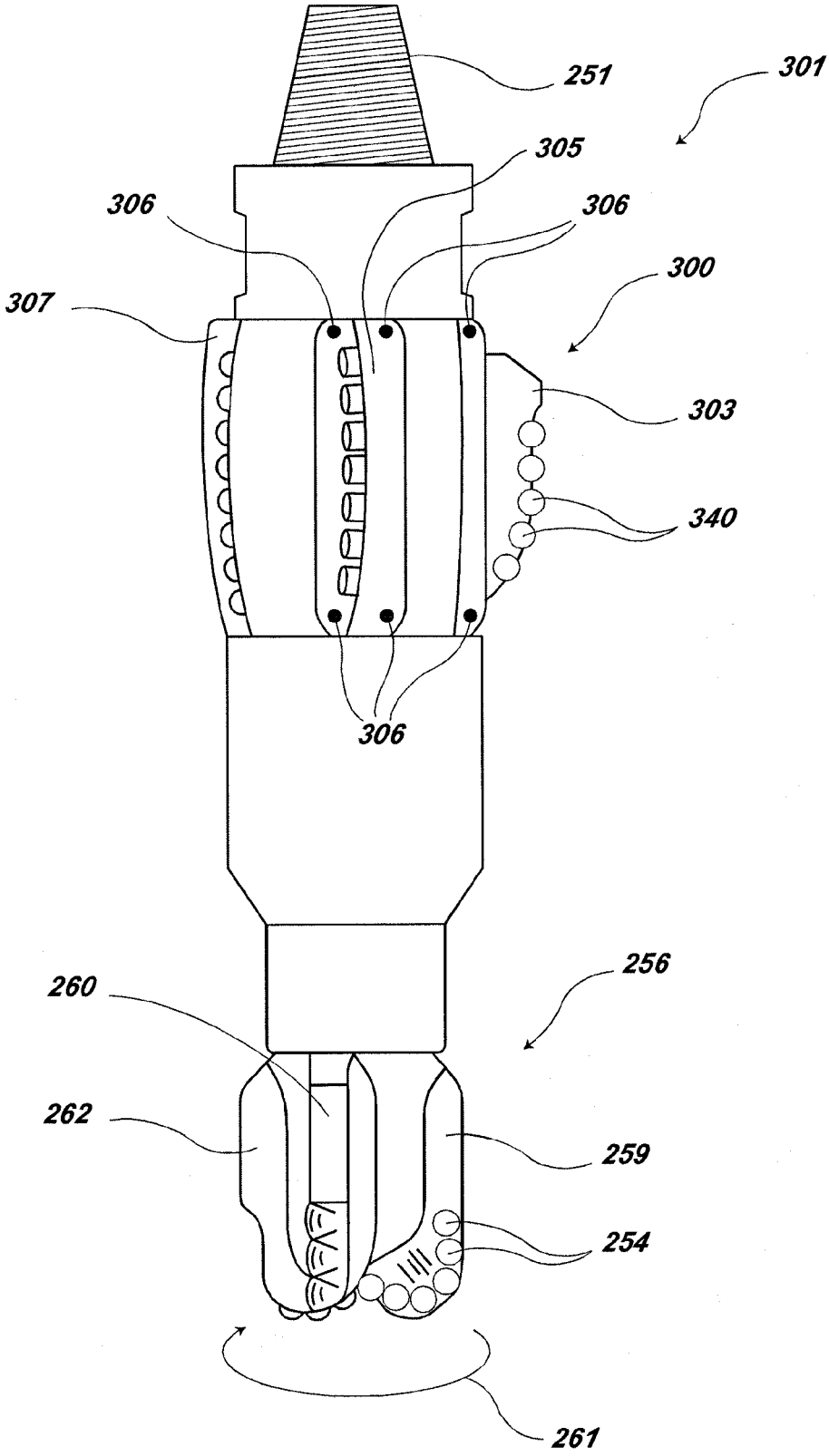
FIG. 11B is a side perspective view of a pilot bit attached to an expandable reamer assembly of the present invention.
Figure 11C:
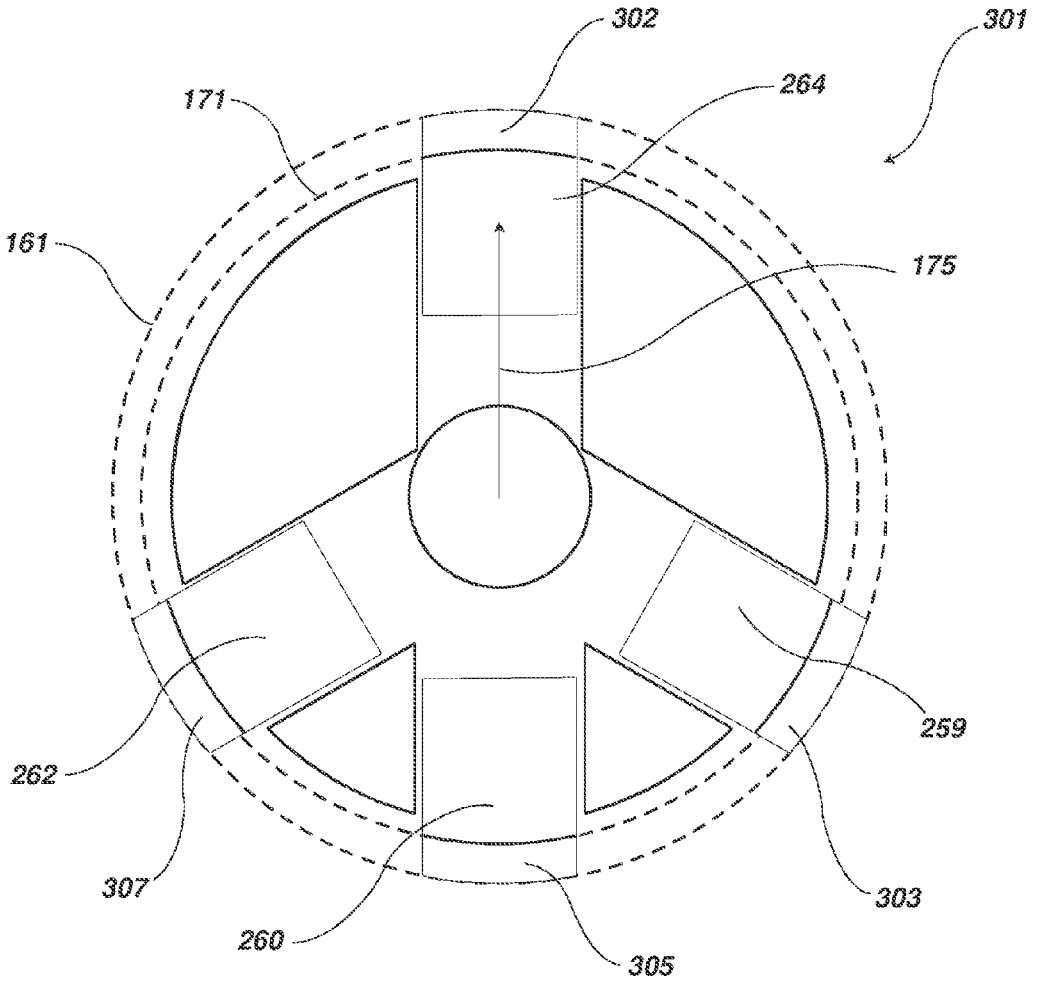
FIG. 11C is a schematic bottom view of the pilot bit and expandable reamer assembly shown in FIG. 11B.

In a further exemplary embodiment of the expandable reamer of the present invention, the vector sum of the cutting forces may be directed toward a fixed bearing pad or movable bearing pad. FIGS. 11B and 11C show an expandable reamer assembly 301 of the present invention in a side perspective view and a schematic top cross-sectional view, respectively. Expandable reamer 300 includes movable blades 303, 305, and 307 disposed therein via removable lock rods (not shown) disposed within holes 306. In addition, movable bearing pad 302 (not shown in FIG. 11B, as it is positioned on the opposite side of the view in FIG. 11B) is disposed within expandable reamer 300. Pilot drill bit 256 may be affixed to expandable reamer 300 via a threaded connection, as known in the art. Pilot drill bit 256, as shown, is a rotary drag bit including blades 259, 260, 262, and bearing pad 264 (not shown in FIG. 11B as it is positioned on the opposite side of the view in FIG. 11B). Pilot drill bit 256 may employ PDC cutting elements 254 although, as previously noted, a tricone pilot bit or other rotary bit may be employed without limitation. Similarly, movable blades 303, 305, and 307 may carry PDC cutting elements 340. The top end of expandable reamer 300 comprises a male-threaded pin connection 251 for threading to a drill string bottom hole assembly or to the output shaft of a downhole motor bearing housing (not shown), the motor typically being a positive-displacement or Moineau-type drilling fluid-driven motor as known in the art. The direction of rotation 261 of the expandable reamer assembly 301 is also shown for clarity.

FIG. 11C shows a schematic bottom cross-sectional view of an expandable reamer assembly 301 of the present invention wherein the sum of cutting forces of the expandable reamer 300 is directed toward a movable bearing pad 302 along direction vector 175 while the sum of the cutting forces of the pilot drill bit 256 (FIG. 11B) is directed toward a drill bit bearing pad 264 along direction vector 175, the drill bit bearing pad 264 and the movable bearing pad 302 being circumferentially aligned. Drill bit blades 259, 260, 262 and bearing pad 264 are arranged circumferentially asymmetrically and configured, sized, and positioned to drill a borehole of reference diameter 171. Similarly, movable blades 303, 305, 307, and movable bearing pad 302 are arranged circumferentially asymmetrically and configured, sized, and positioned to ream a borehole of reference diameter 161 corresponding to their outermost lateral positions, respectively.

The vector sum of the forces generated by PDC cutting elements 254 carried by pilot drill bit 256 during drilling may be directed along direction vector 175. Likewise, the vector sum of the forces generated by PDC cutting elements 340 carried by expandable reamer 300 may be directed along direction vector 175. In doing so, the vector sum of the cutting forces of PDC cutting elements 254 carried by the pilot drill bit 256 may be directed toward the drill bit bearing pad 264. Further, the vector sum of the cutting forces of PDC cutting elements 340 carried by expandable reamer 300 may be directed toward movable bearing pad 302. Such a configuration may be advantageous as inhibiting whirl motion of the expandable reamer assembly 301. Alternatively, the drill bit bearing pad 264 and the movable bearing pad 302, as well as the respective sum of the cutting forces of each, may be directed to different circumferential positions to improve operational characteristics of the expandable reamer assembly 301. Thus, antiwhirl concepts may be applied to the movable blades, fixed bearing pads, and movable bearing pads of an expandable reamer of the present invention in any combination with drill bits and associated antiwhirl configurations.

Figure 12:
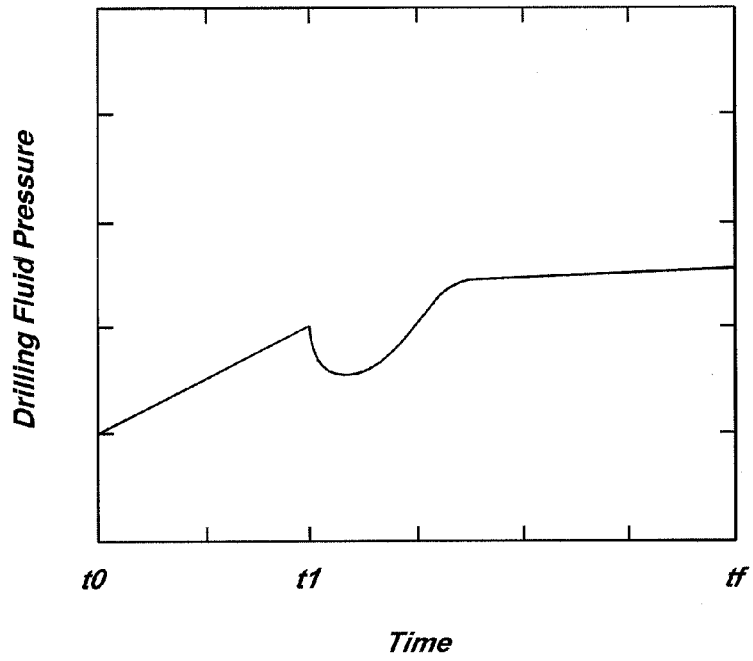
FIG. 12 is a conceptual depiction of a pressure signature during operation of the expandable reamer of the present invention.

As mentioned hereinabove, perceptible drilling fluid pressure responses may indicate an operational state of an expandable reamer of the present invention, and it may be advantageous to configure an expandable reamer of the present invention to exhibit such drilling fluid pressure responses. FIG. 12 shows a conceptual depiction of a perceptible pressure response occurring during the increase in drilling fluid flow between starting time t0 and ending time tf for an expandable reamer according to the present invention wherein a sliding mechanism, such as the aforementioned actuation sleeve 40, moves to allow drilling fluid pressure to force movable blades 12 and 14 radially or laterally outward. Considering the actuation sleeve configuration shown in FIG. 1A, at time t1 (labeled "Trigger Point"), drilling fluid may begin to communicate with annulus 17 by way of apertures 42 in actuation sleeve 40 and may also exit from port 34, and, accordingly, the drilling fluid pressure may drop. Alternatively, an actuation sleeve or actuation mechanism may suddenly pressurize annulus 17 by way of a shear pin or other frangible member that suddenly allows the actuation sleeve to move, thus causing the drilling fluid pressure to drop. Subsequent to the initial communication of drilling fluid pressure to annulus 17 and movable blades 12 and 14, drilling fluid pressure may build within the annulus 17 as the blade-biasing elements 24, 26, 28, and 30 resist the movement of movable blades 12 and 14. Further, drilling fluid pressure may equalize and then may continue to rise to a desired level as an equilibrium flow rate is established through the expandable reamer 10.

Figure 13:
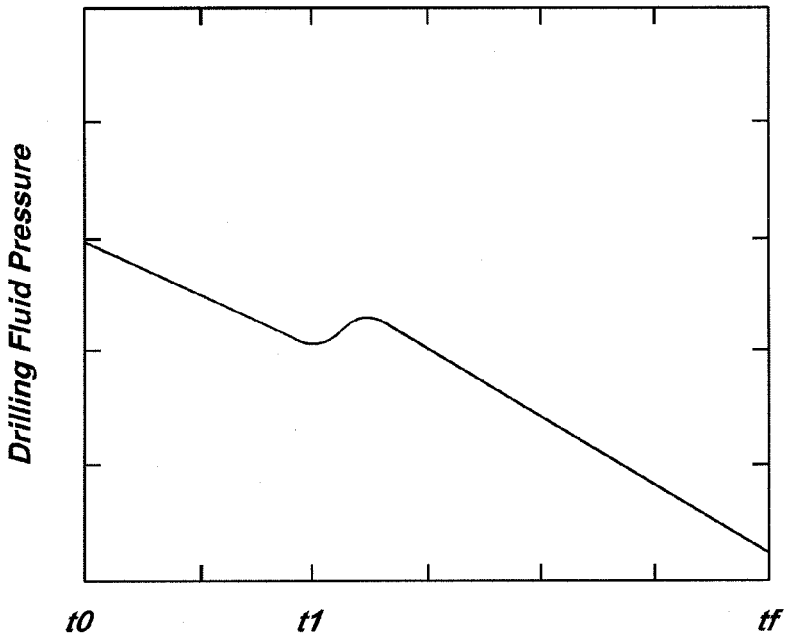
FIG. 13 is a conceptual depiction of a pressure signature during operation of the expandable reamer of the present invention.

FIG. 13 shows a conceptual depiction of a perceptible drilling fluid pressure response occurring during the decrease in drilling fluid flow between starting time t0 and ending time tf for an expandable reamer 10 as shown in FIG. 1B, wherein actuation sleeve 40 is positioned to prevent drilling fluid from communicating with movable blades 12 and 14. As drilling fluid flow is reduced, actuation sleeve 40 may be biased to prevent drilling fluid pressure from communicating with movable blades 12 and 14 at time t1, which may cause the drilling fluid pressure to rise temporarily. Thus, the contraction of the movable blades 12 and 14 may cause a perceptible drilling fluid pressure response comprising a decrease in drilling fluid pressure, followed by a rise in drilling fluid pressure and followed by a continued decline in drilling fluid pressure.

Accordingly, as described above, the actuation sleeve configuration and movable blade configuration may be selectively tailored to correspondingly affect the drilling fluid pressure response in relation to an operational characteristic of the expandable reamer. Further, the present invention also contemplates additional alternatives for tailoring a drilling fluid pressure response during operation of an expandable reamer. For instance, the activation mechanism of the expandable reamer may be designed to gradually or suddenly prevent or allow communication of the drilling fluid with the movable blade sections, thus potentially creating differing drilling fluid pressure responses. Further, a fluid aperture or port that is included in an expandable reamer may be configured with at least one burst disc, which may be designed to rupture at a selected pressure and may generate a perceptible drilling fluid pressure response. Additionally, fluid aperture sizes, annulus sizes, and biasing elements may be tailored to enhance or modify the drilling fluid pressure response characteristics of an expandable reamer during operation thereof.

Figure 14A:
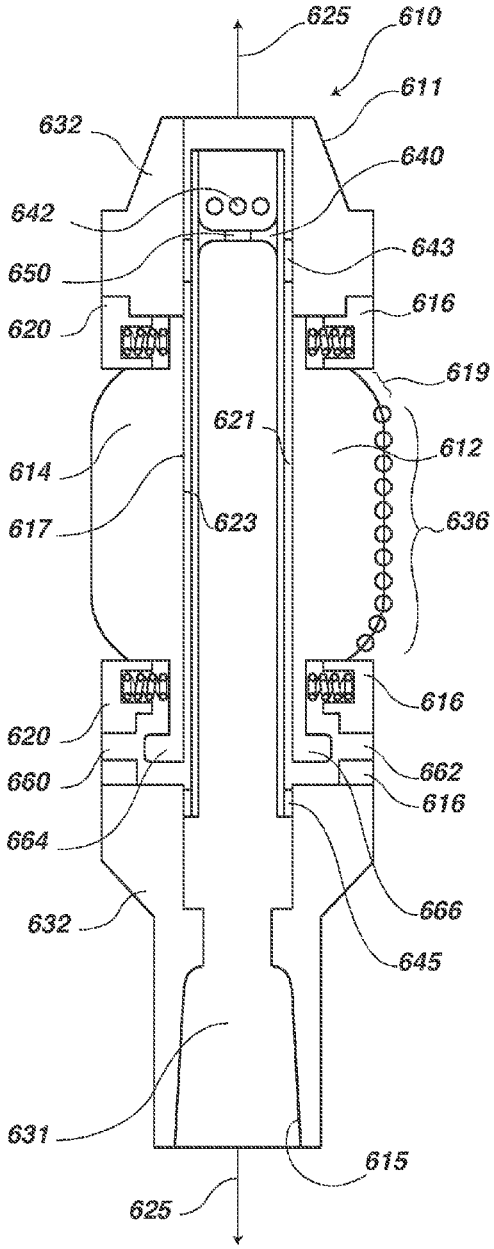
FIGS. 14A and 14B illustrate side cross-sectional views of an expandable reamer of the present invention including a tailored fluid path for accentuating a pressure response in relation to expansion of movable blades in a contracted state and an expanded state, respectively.
Figure 14B:
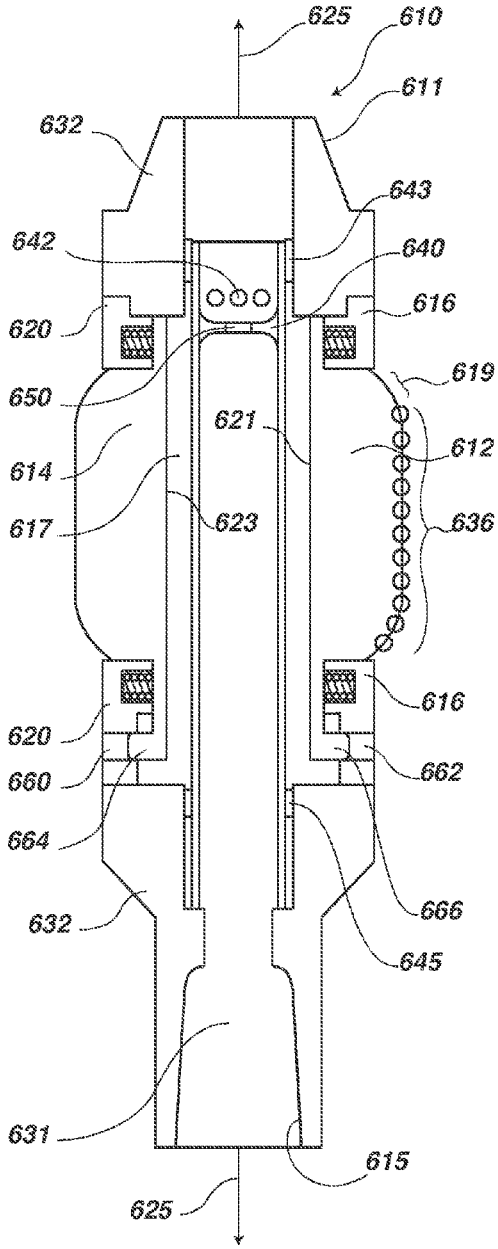

Further, it may be advantageous to tailor the fluid path through the expandable reamer in relation to an operational state thereof. FIGS. 14A and 14B show an expandable reamer 610 of the present invention including tubular body 632, bore 631, and movable blades 612 and 614 carrying cutting elements 636 (shown only on movable blade 612 for clarity) outwardly spaced from centerline or longitudinal axis 625 of the tubular body 632. Retention elements 616 and 620 may retain movable blades 612 and 614 within tubular body 632 by way of removable lock rods (not shown) or as otherwise configured. Tubular body 632 may include a male-threaded pin connection 611 and female-threaded box connection 615.

As in other embodiments of the expandable reamer of the present invention described herein, the position of actuation sleeve 640 may allow or prevent drilling fluid from acting upon inner surfaces 621 and 623 of movable blades 612 and 614, respectively. Specifically, actuation sleeve 640 may include a reduced cross-sectional orifice 650 configured to develop force thereon by way of drilling fluid flowing therethrough. Thus, in an initial position (not shown), apertures 642 may be positioned above an actuation seal 643, preventing drilling fluid from acting on movable blades 612 and 614, as shown in FIG. 14A. In addition, seal 645 may prevent drilling fluid passing through the actuation sleeve 640 from communicating with annulus 617. However, upon sufficient force developed by way of drilling fluid passing through the reduced cross-sectional orifice 650, the actuation sleeve 640 may move to a longitudinal position as shown in FIG. 14B, thus allowing drilling fluid to act upon the inner surfaces 621 and 623 of movable blades 612 and 614, respectively.

In relation to a fluid path that may be tailored to generate an amplified or distinctive drilling fluid pressure response, as shown in FIGS. 14A and 14B, one possible way to do this may be to provide ports 660 and 662 formed within retention elements 620 and 616, respectively, that allow drilling fluid to pass from the inside of expandable reamer 610 to the outside thereof upon the drilling fluid becoming communicative with the movable blades 612 and 614. However, as the movable blades 612 and 614 expand radially or laterally outwardly, the ports 660 and 662 may become increasingly sealed or blocked in relation to the displacement of the movable blades 612 and 614 toward their outermost radial or lateral position. More specifically, plugs 664 and 666, affixed to movable blades 612 and 614, are displaced therewith and, upon sufficient displacement, may fit into and substantially seal ports 660 and 662, respectively. Upon the movable blades 612 and 614 reaching their outermost radial or lateral positions, ports 660 and 662 may become substantially blocked, thus impeding the flow of drilling fluid from the inside of the expandable reamer 610 therethrough to the outside of the expandable reamer 610, as shown in FIG. 14B. Thus, as the movable blades 612 and 614 move into an expanded position, the ports 660 and 662 are initially open and become increasingly sealed or blocked by the displacement thereof. In turn, as the ports 660 and 662 become blocked, the drilling fluid pressure within the expandable reamer 610 may increase, forcing the movable blades 612 and 614 radially or laterally outwardly. Thus, the drilling fluid pressure within the expandable reamer 610 may rapidly increase as the movable blades 612 and 614 are displaced to their outermost radial or lateral positions. Accordingly, the relatively rapid increase in drilling fluid pressure may be desirable as being perceptible and distinctive, as well as indicating that the movable blades 612 and 614 are positioned substantially at their outermost radial or lateral position. Accordingly, a drilling fluid pressure response may indicate the operational state of an expandable reamer and may be tailored by way of modifying at least one drilling fluid path communicating drilling fluid therethrough. Further, taper 619 may facilitate return of movable blades 612 and 614 laterally inwardly, upon sufficient reduction of drilling fluid pressure, if the blade-biasing elements 574, 576, 578, and 580 (FIG. 8B) fail to do so.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A method of operating an expandable reamer, the method comprising:

increasing a flow rate of drilling fluid through the expandable reamer to cause at least one blade of the expandable reamer to move from a retracted position to an expanded position while the expandable reamer is positioned downhole;

decreasing the flow rate of drilling fluid through the expandable reamer to cause the at least one blade of the expandable reamer to move from the expanded position to the retracted position while the expandable reamer is positioned downhole; and increasing the flow rate of the drilling fluid through the expandable reamer and maintaining the at least one blade of the expandable reamer in the retracted position while the expandable reamer is positioned downhole.

2. The method of claim 1, further comprising decreasing the flow rate of drilling fluid through the expandable reamer and then increasing the flow rate of drilling fluid through the expandable reamer to cause at least one blade of the expandable reamer to move from the retracted position to the expanded position while the expandable reamer is positioned downhole.

3. The method of claim 1, further comprising selectively and repeatably moving an actuation member between a first position and a second position relative to a tubular body of the expandable reamer.

4. The method of claim 1, wherein increasing the flow rate of the drilling fluid comprises increasing the flow rate of the drilling fluid to a flow rate greater than about 400 gallons per minute.

5. The method of claim 1, wherein decreasing the flow rate of the drilling fluid comprises decreasing the flow rate of the drilling fluid to a flow rate less than about 400 gallons per minute.

6. The method of claim 1, further comprising selectively and repeatably moving an actuation member between a first longitudinal position and a second longitudinal position relative to a tubular body of the expandable reamer.

7. A method of operating an expandable reamer, the method comprising:

increasing a flow rate of drilling fluid through the expandable reamer to cause an actuation member of the expandable reamer to move from a first position to a second position while the expandable reamer is positioned downhole;

decreasing the flow rate of drilling fluid through the expandable reamer to cause the actuation member of the expandable reamer to move from the second position to the first position while the expandable reamer is positioned downhole; and increasing a flow rate of drilling fluid through the expandable reamer to cause the actuation member of the expandable reamer to move from a first position to a third position while the expandable reamer is positioned downhole.

8. The method of claim 7, wherein increasing the flow rate of the drilling fluid comprises increasing the flow rate of the drilling fluid to a flow rate greater than about 400 gallons per minute.

9. The method of claim 8, wherein decreasing the flow rate of the drilling fluid comprises decreasing the flow rate of the drilling fluid to a flow rate less than about 400 gallons per minute.

10. An expandable reamer for drilling a subterranean formation, comprising:

a tubular body;

at least one blade carried by the tubular body; and an actuation member selectively and repeatably positionable between a first position within the tubular body and a second position within the tubular body, and configured to maintain the expandable reamer in a first operating condition when the actuation member is positioned in the first position and to maintain the expandable reamer in a second operating condition when the actuation member is positioned in the second position.

11. The expandable reamer of claim 10, further comprising a biasing element positioned and configured to bias the actuation member to a third position within the tubular body.

12. The expandable reamer of claim 11, further comprising a pin guide assembly comprised within a circumferentially extending groove, the circumferentially extending groove comprising a pattern of peaks and valleys.

13. The expandable reamer of claim 11, wherein each of the first position, the second position and the third position comprise different longitudinal positions within the tubular body.

14. The expandable reamer of claim 11, wherein each of the first position, the second position and the third position further comprise different circumferential positions within the tubular body.

15. The expandable reamer of claim 10, wherein the actuation member comprises a sleeve.

16. The expandable reamer of claim 10, wherein the first operating condition comprises the at least one blade positioned in a fully refracted position.

17. The expandable reamer of claim 16, wherein the second operating condition comprises the at least one blade positioned in a fully extended position.

18. The expandable reamer of claim 10, wherein the actuation member is configured to maintain the expandable reamer in each of a first operating condition and a second operating condition when the actuation member is respectively positioned in the first position and in the second position under substantially identical rates of drilling fluid flow through the tubular body.

19. The expandable reamer of claim 18, wherein the substantially identical rates of drilling fluid flow comprise a substantially identical flow rates of greater than about 400 gallons per minute.

20. The expandable reamer of claim 19, wherein the substantially identical rates drilling fluid flow comprise substantially identical flow rates of about 800 gallons per minute.

* * * * *

UNITED STATES PATENT AND TRADEMARK OFFICE

CERTIFICATE OF CORRECTION

PATENT NO. : 8,215,418 B2
APPLICATION NO. : 13/213641
DATED : July 10, 2012
INVENTOR(S) : Steven R. Radford It is certified that error appears in the above-identified patent and that said Letters Patent is hereby corrected as shown below:

In the specification:

COLUMN 9, LINE 43, Change "Movable elements"
to --Movable bearing-pad-biasing elements--

Signed and Sealed this
First Day of December, 2015

Michelle K. Lee

Michelle K. Lee
*Director of the United States Patent and Trademark Office*